US007980888B1

(12) United States Patent
Fukushima

(10) Patent No.: US 7,980,888 B1
(45) Date of Patent: Jul. 19, 2011

(54) PLUG WITH A REGULATION PIN TO NOTIFY THE REQUIRED VOLTAGE

(75) Inventor: Noriyuki Fukushima, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 12/892,064

(22) Filed: Sep. 28, 2010

(30) Foreign Application Priority Data

Sep. 28, 2009 (JP) ..... 2009-223294
Sep. 2, 2010 (JP) ..... 2010-196579

(51) Int. Cl.
*H01R 3/00* (2006.01)

(52) U.S. Cl. ..... 439/489

(58) Field of Classification Search ..... 439/489, 439/488, 490, 491
See application file for complete search history.

(56) References Cited

U.S. PATENT DOCUMENTS 4,543,448 A * 9/1985 Deurloo ..... 174/112
6,114,833 A * 9/2000 Langston et al. ..... 320/109
7,121,873 B2 * 10/2006 Wu et al. ..... 439/489
7,852,609 B2 * 12/2010 Yang ..... 361/78
2005/0106930 A1 * 5/2005 Wu et al. ..... 439/489
2010/0285695 A1 11/2010 Ueno et al.

FOREIGN PATENT DOCUMENTS

| | | |
|---|---|---|
| JP | 62-150879 | 9/1987 |
| JP | 63-19738 | 2/1988 |
| JP | 2005-284080 | 10/2005 |
| JP | 2005-294077 | 10/2005 |
| JP | 2009-146827 | 7/2009 |
| JP | 2009-151947 | 7/2009 |
| JP | 2009-158109 | 7/2009 |
| JP | 2009-158303 | 7/2009 |

* cited by examiner

*Primary Examiner* — Chandrika Prasad

(74) *Attorney, Agent, or Firm* — McDermott Will & Emery LLP

(57) ABSTRACT

A plug 100 includes a regulation pin 108 in addition to negative and positive terminals 106 and 110. A detection pin 208 of a plug receiver 200 is pushed down by the regulation pin 108 when the plug 100 is inserted into the plug receiver 200. The push-down amount of the detection pin 208 is detected by a plurality of depth sensors 216, whereby DC operating voltage to be supplied to the plug 100 is identified.

20 Claims, 24 Drawing Sheets

PLUG WITH A REGULATION PIN TO NOTIFY THE REQUIRED VOLTAGE

BACKGROUND OF THE INVENTION

1. Field of the Invention

The present invention relates to a wiring plug-in connector and the like and, more particularly, to a wiring plug-in connector for DC voltage.

2. Description of Related Art

Power supplied from a power-generating station to the home is alternate current. Many of electronic devices used in the home operate with DC voltage, so that an AC adapter for converting AC voltage to DC voltage is required. Required DC voltage (hereinafter, referred to as "DC operating voltage") differs for each electronic device and therefore many types of AC adapters are required for the home. Further, there exists a problem that power loss is caused at the time when AC/DC conversion is performed using the AC adapter.

With the progress of a technology concerning renewable energy, decentralization/diversification of a power generation source is expected in the future. The use of a DC power generation source such as photovoltaic generation or fuel cell can eliminate the need to use the AC adapter. Hereinafter, DC voltage supplied from a DC power generation source is referred to as "DC supply voltage".

[Citation List]

[Patent Document]

[Patent Document 1] Jpn. Pat. Appln. Laid-Open Publication No. 2009-151947

[Patent Document 2] Jpn. UM Appln. Laid-Open Publication No. 62-150879

[Patent Document 3] Jpn. UM Appln. Laid-Open Publication No. 63-19738

[Patent Document 4] Jpn. Pat. Appln. Laid-Open Publication No. 2009-146827

[Patent Document 5] Jpn. Pat. Appln. Laid-Open Publication No. 2005-294077

[Patent Document 6] Jpn. Pat. Appln. Laid-Open Publication No. 2005-284080

[Patent Document 7] Jpn. Pat. Appln. Laid-Open Publication No. 2009-158303

As described above, the DC operating voltage differs for each electronic device, so that it is necessary to convert predetermined DC supply voltage to desired DC operating voltage. To this end, a mechanism for detecting the DC operating voltage of each electronic device is required. In the case of Patent Document 1, a DC device (electronic device) superimposes adapted voltage information onto DC voltage to thereby notify a DC outlet of an adapted voltage value (DC operating voltage) (refer to, e.g., paragraph [0021] of Patent Document 1). However, this method requires additional circuit configuration in both the electronic device and DC outlet, complicating a system configuration.

SUMMARY

The present invention has been made based on the above problem and a main object thereof is to achieve detection/supply of DC operating voltage with a simple mechanism.

A plug according to the present invention has a plurality of pins to be inserted into a plug receiver for a variable DC voltage supply. The plurality of pins include: a regulation pin that specifies required DC operating voltage by its shape; and an electrode pin that receives the specified DC voltage from the variable DC voltage supply.

The DC operating voltage is specified by the physical shape of the regulation pin, eliminating the need to provide a special control system on the plug side.

The length of the regulation pin may be increased in an insertion depth direction as required DC operating voltage becomes higher. The regulation pin may detachably be configured.

The electrode pin may include a cylindrical first electrode pin and a cylindrical second electrode pin which is concentric to the first electrode pin and has a larger diameter than the first electrode pin. The regulation pin may be provided inside the cylindrical first electrode pin. The regulation pin may also be used as an earth terminal.

The first electrode pin may have a penetration hole into which the regulation pin inserts. The regulation pin may have a flange part and the end of the first electrode pin may be covered by with flange part. By covering the end of the first electrode with the flange part, insulation between the first electrode pin and the second electrode pin is more ensured. Furthermore, the first electrode pin is more protected from the external impact or dust.

A plug according to the present invention has a plurality of pins to be inserted into or contacted with a plug receiver of a variable voltage supply. The plurality of pins include: a regulation pin of insertion type that specifies required DC operating voltage by its shape; and an electrode pin of contact type that receives the specified DC operating voltage from the variable DC voltage supply.

The plug may be connected with the plug receiver using a magnet. For example, by setting a magnet or an iron on the contact surfaces of the plug and the plug receiver respectively, the contact between the plug and the plug receiver can be settled.

A plug receiver according to the present invention has: a plurality of jacks for receiving an electrode pin and a regulation pin provided in a plug; and a voltage identification unit that identifies the magnitude of DC operating voltage to be supplied to the electrode pin based on the shape of the regulation pin.

The magnitude of the DC operating voltage identified by the voltage identification unit may be increased as the regulation pin is inserted deeper. The DC operating voltage is identified by the physical feature of the regulation pin, such as the shape or insertion depth thereof, simplifying the configuration of a circuit on the plug receiver side.

The plug receiver may further have a voltage conversion unit that converts the DC supplied voltage supplied from a predetermined DC voltage supply into the identified DC operating voltage. The plug receiver may further have: a voltage display unit that displays the magnitude of the identified DC voltage; and a determination input unit that receives a determination input for determining the identified DC voltage from a user. The voltage conversion unit may supply the identified DC voltage to the electrode pin under the condition that the determination input has been received. By prompting user's confirmation, it is possible to supply the DC operating voltage more safely.

The plug receiver may have a plurality of depth sensors which are arranged in the insertion depth direction and detect the insertion depth of the regulation pin. The voltage conversion unit may supply DC operating voltage corresponding to a first insertion depth when a depth sensor corresponding to the first insertion depth detects insertion, under the condition that all depth sensors corresponding to shallower depth than the first insertion depth detect insertion.

The depth sensor may detect the insertion depth of the regulation pin directly or indirectly. For example, by detecting a component that is moved according to the insertion of the regulation pin, the insertion depth may be detected. When a depth sensor in deep position shows detection, a depth sensor in shallower position must have shown detection. In case some depth sensors in shallower position do not show detection though the depth sensor in deep position shows detection, a malfunction may have occurred. By supplying the DC operating voltage under the condition that all depth sensors in shallower positions show detection, it makes easier to avoid supplying the DC operating voltage in case of malfunction.

The plug receiver may include a detection pin which opposes the regulation pin when the plug is inserted and is movable in the insertion depth direction according to the movement of the regulation pin. The voltage identification unit identifies the magnitude of DC operating voltage by detecting the length of the regulation pin based on the magnitude of the movement of the detection pin when the plug is inserted.

The plug receiver may include movable component which is movable in the insertion depth direction together with the detection pin and a plurality of depth sensors which are arranged for detecting the end of the movable component passing. The end of the movable component protrudes from the side surface of the region into which the plug is inserted. The plurality of depth sensors may be arranged in the passing direction of the end. The voltage identification unit may identify the magnitude of the movement of the detection pin based on the detection signals from the plurality of depth sensors.

As machinery for detecting the movement of the movable component is not provided under the insertion region of the plug but side of the insertion region, it makes easier to shorten the plug receiver in the insertion depth direction (See FIGS. 11 and 12).

The plurality of depth sensors may be classified into a first sensor group corresponding to a first end of the movable component and a second sensor group corresponding to a second end of the movable component. A depth sensor in the first sensor group and a depth sensor in the second sensor group may be arranged in deeper and deeper position alternately. With this arrangement, it makes easier to identify the DC operating voltage precisely (See FIG. 22).

A cover cap which seals a jack from internal may be provided. The cover cap can be configured to move in the insertion direction of the plug.

By providing with the cover cap, the jack can be sealed when the power supply is not used. Consequently, it makes easier to prevent foreign bodies, such as dust, finger and the like, from invading into the jack.

The plug receiver may include a check sensor for detecting whether the plug is inserted to a predetermined position. The voltage conversion unit may supply the DC operating voltage to the electrode pin under the condition that the check sensor shows detection.

The "predetermined position" may be a position in case the plug is inserted into the plug receiver completely. The predetermined position may be at least a position in case the plug is inserted into the plug receiver sufficiently. By supplying the DC operating voltage under the condition of insertion to the predetermined position, it makes easier to avoid supplying voltage in case the plug is not connected sufficiently.

The voltage conversion unit may stop supplying the DC operating voltage regardless of the result of the depth sensors when the detection signal from the check sensor is stopped during the supply of the DC operating voltage. In case the plug is pulled out during the supply, the detection signal from the checking sensor is stopped. In this case, it makes safer to stop supply of the DC operating voltage.

Once the supply of the DC operating voltage stopped, the voltage conversion unit can resume supply under the condition that all detection signals from the check sensor and the depth sensors are stopped. With this processing, the supply of DC operating voltage is resumed under the condition that the plug is once pulled out completely. It makes the power supply safer.

A wiring plug-in connector according to the present invention has a plug and a plug receiver receiving a plurality of pins provided in the plug. The plug includes: a regulation pin that specifies required DC operating voltage by the shape thereof; and an electrode pin that receives the specified DC operating voltage from the plug receiver. The plug receiver includes: a plurality of jacks for receiving the electrode pin and regulation pin; and a voltage identification unit that identifies the magnitude of DC voltage to be supplied to the electrode pin based on the shape of the regulation pin.

According to the present invention, it is possible to provide sufficient DC voltage with a simple mechanism.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

A preferred embodiment of the present invention will be described below with reference to the accompanying drawings.

Figure 1:
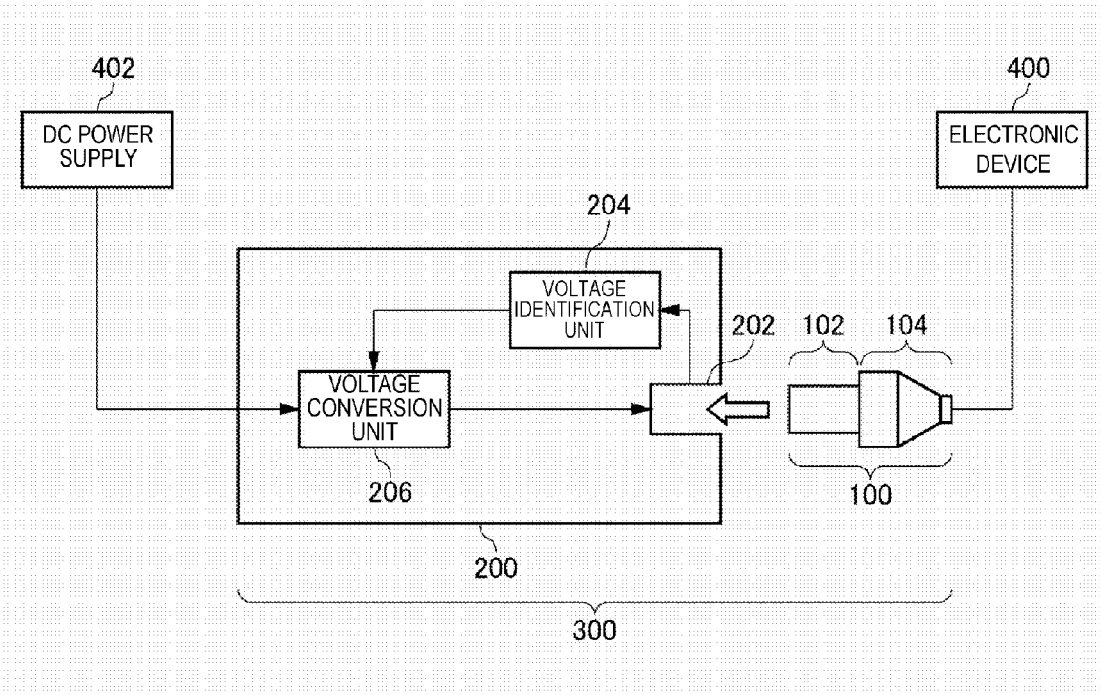
FIG. 1 is a system configuration view of a wiring plug-in connector.

FIG. 1 is a system configuration view of a wiring plug-in connector 300. The configuration of a wiring plug-in connector 300 of FIG. 1 is common among the first to the fourth embodiment described later. The wiring plug-in connector 300 includes a plug 100 and a plug receiver 200. The plug 100 is connected to an electronic device 400. The electronic device 400 is, e.g., a TV set, a notebook PC, a table lamp, or the like, and the DC operating voltage of the electronic device 400 differs depending on what the electronic device 400 is. The plug receiver 200 is connected to a DC power supply 402. The DC power supply 402 is, e.g., a solar battery, a fuel battery, or the like.

The plug 100 includes a plug-in unit 102 and a grip unit 104. When the plug-in unit 102 is inserted into a receiving portion 202 of the plug receiver 200, an electrical path is established between the DC power supply 402 and electronic device 400, whereby the DC operating voltage is supplied to the electronic device 400.

The plug receiver 200 includes a voltage identification unit 204 and a voltage conversion unit 206. The plug-in unit 102 has a regulation pin 108 (not illustrated in FIG. 1) inside thereof. When the plug-in unit 102 is inserted into the receiving portion 202, the voltage identification unit 204 detects the length of the regulation pin 108 in the plug-in unit 102 and identifies the DC operating voltage based on the detected length. A configuration of the regulation pin 108 will be described later using FIG. 2, FIG. 12 and the like, and an identification method of the DC operating voltage will be described later using FIGS. 3, 4, 11 and the like.

The voltage conversion unit 206 converts the DC supply voltage from the DC power supply 402 into the DC operating voltage for the electronic device 400. The DC operating voltage is supplied to the electronic device 400 through the receiving portion 202 and plug-in unit 102. The DC power supply 402 and plug receiver 200 substantially function as a variable DC voltage supply.

That is, when the plug 100 is inserted into the receiving portion 202, the plug receiver 200 detects/supplies the DC operating voltage for the electronic device 400. The plug receiver 200 maybe an electrical outlet installed on the wall or floor of a building or a power strip drawn from the electrical outlet.

The plug receiver 200 receives the DC supply voltage from the DC power supply 402, converts the received DC supply voltage into the DC operating voltage, and supplies the DC operating voltage to the electronic device 400, so that a power loss associated with AC/DC conversion does not occur. Further, the need to use an AC adapter is eliminated. Even in the case where the electronic device 400 is an electronic device of a type that incorporates the AC adapter (AC/DC converter function), the DC operating voltage supplied from the plug 100 passes through a rectifier of the internal AC adapter without being modified, suppressing the power factor from being reduced by the rectifier. Thus, even a general electronic device 400 designed on the assumption that it receives AC voltage like the electronic device 400 incorporating the AC adapter can use the plug receiver 200 to receive adequate DC operating voltage simply by using the plug 100 in place of the currently used plug. For example, in the case where the electronic device 400 can operate at an AC voltage of 100 (V), supplying a DC operating voltage of 141 (V) which is the crest value of the AC voltage (100 V) sometimes allows the electronic device 400 to operate.

First Embodiment

Figure 2:
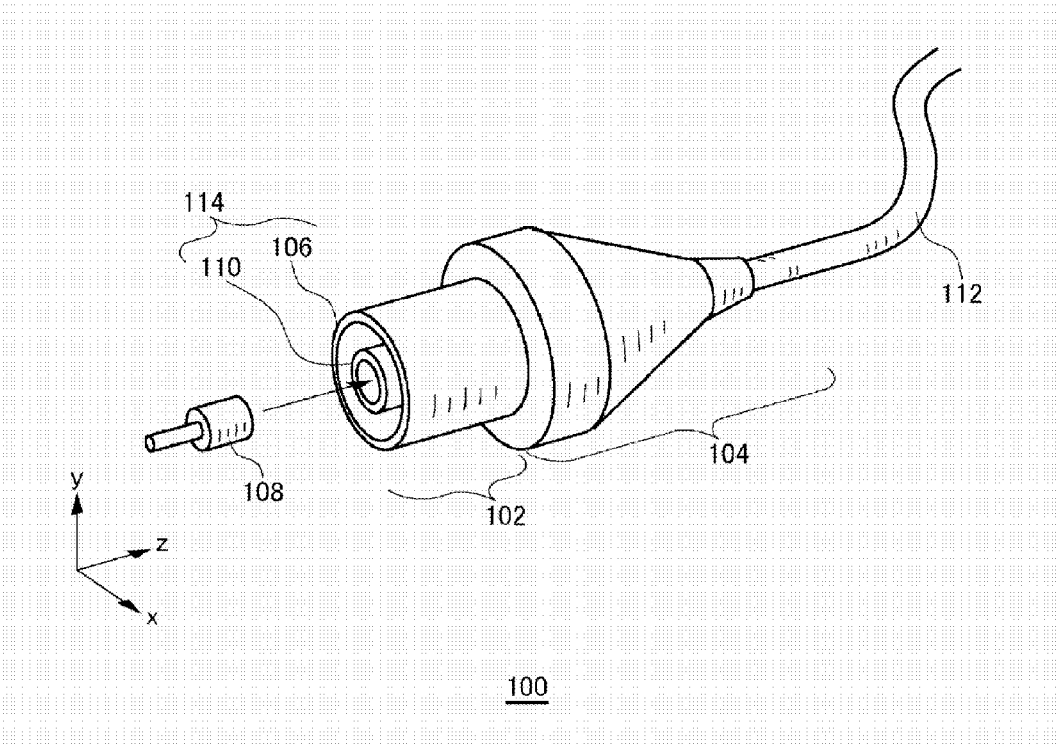
FIG. 2 is a view illustrating the outer appearance of a plug.

FIG. 2 is a view illustrating the outer appearance of the plug 100 according to the first embodiment. A z-axis is set in an axial direction from the plug-in unit 102 toward the grip unit 104, and x- and y-axes orthogonal to the z-axis are set as illustrated in FIG. 2. A cord 112 extending from the grip unit 104 is connected to the electronic device 400. The plug-in unit 102 includes a positive terminal 110 and a negative terminal 106. The positive terminal 110 and negative terminal 106 are each a cylindrical metal terminal and have a concentric shape. The negative terminal 106 has a larger diameter than the positive terminal 110. The positive terminal 110 may be provided outside the negative terminal 106. The positive and negative terminals 110 and 106 constitute an electrode pin 114.

The regulation pin 108 is set inside the positive terminal 110. The regulation pin 108 of the first embodiment is made of stainless steel. The regulation pin 108 may be made of another material such as resin. The regulation pin 108 specifies the DC operating voltage by the length of the z-axis. In the plug 100 of the first embodiment, the length of the regulation pin 108 is increased for higher DC operating voltage. The regulation pin 108 is exchangeable. Therefore, an adequate regulation pin 108 may be selected in accordance with the DC operating voltage of the electronic device 400. The configuration of the plug 100 itself is not changed depending on the DC operating voltage.

Figure 3:
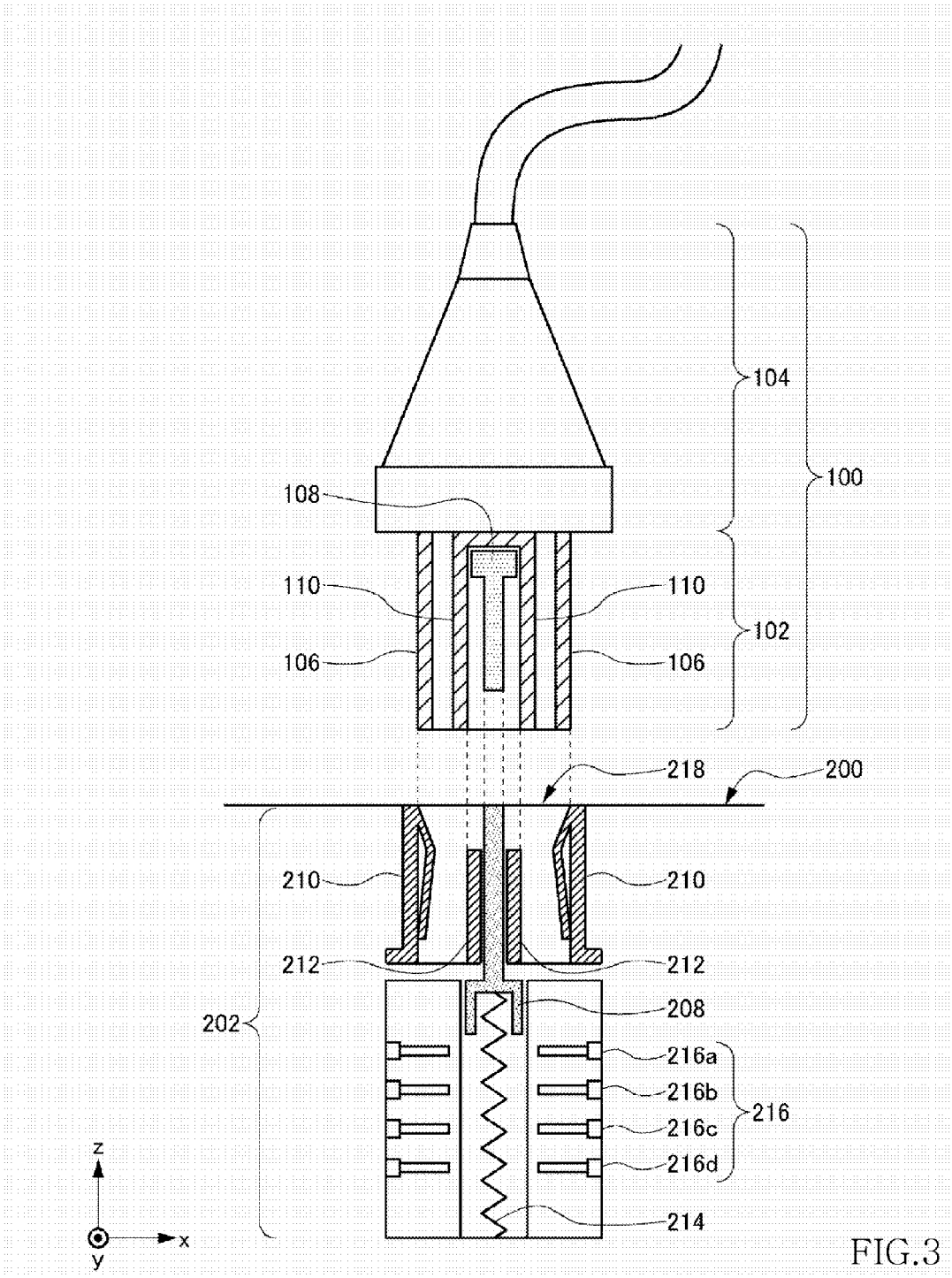
FIG. 3 is a side cross-sectional view illustrating a connection portion between the plug and plug receiver of FIG. 2 in a state before the plug is inserted into the plug receiver.

FIG. 3 is a side cross-sectional view illustrating a connection portion between the plug 100 and plug receiver 200 in a state before the plug 100 is inserted into the plug receiver 200 according to the first embodiment. The receiving portion 202 of the plug receiver 200 includes a hollow portion 218, and the plug-in unit 102 of the plug 100 is inserted into the hollow portion 218. A negative electrode 210 and a positive electrode 212 are formed outside and inside the hollow portion 218, respectively. When the plug-in portion 102 is inserted into the hollow portion 218, the negative terminal 106 is brought into contact with the negative electrode 210, and the positive terminal 110 are brought into contact with the positive electrode 212, whereby negative potential is supplied from the negative electrode 210 to negative terminal 106, and positive potential is supplied from the positive electrode 212 to positive terminal 110. As is clear from the structure illustrated in FIG. 2, the positive terminal 110 is never brought into contact with the negative electrode 210, and the negative terminal 106 is never brought into contact with the positive electrode 212.

A detection pin 208 is housed inside the positive electrode 212. The detection pin 208 is supported by a spring 214. When the plug-in unit 102 is inserted into the hollow portion 218, the regulation pin 108 pushes the detection pin 208 in a z-axis negative direction (downward direction in FIG. 3). Depth sensors 216*a* to 216*d* (Photoelectric sensors) are arranged below the detection pin 208. When the pushed detection pin 208 passes through the depth sensor 216*a*, the depth sensor 216*a* transmits a detection signal to the voltage identification unit 204. When the detection pin 208 is further pushed, the depth sensor 216*b* also transmits a detection signal. The longer the regulation pin 108 is, the deeper the detection pin 208 is pushed down.

In the first embodiment, when only the depth sensor 216*a* transmits a detection signal, the voltage identification unit 204 identifies that the DC operating voltage is 5 (V). When the depth sensor 216*b* also transmits a detection signal, the voltage identification unit 204 identifies that the DC operating voltage is 12 (V). When the depth sensor 216*c* also transmits a detection signal, the voltage identification unit 204 identifies that the DC operating voltage is 16 (V). When the depth sensor 216*d* also transmits a detection signal, the voltage identification unit 204 identifies that the DC operating voltage is 24 (V). That is, the travel distance (the magnitude of the movement) of the detection pin 208 is changed in accordance with the length of the regulation pin 108, reaction of the depth sensor 216 is changed in accordance with the travel distance of the detection pin 208, and the DC operating voltage is identified by the reaction of the depth sensor 216. With such a mechanism, the plug 100 can notify the plug receiver 200 of the magnitude of the DC operating voltage by the length of the regulation pin 108.

A proximity sensor may be used in place of the photoelectric sensor 216 as a depth sensor. Alternatively, a configuration may be employed in which the depth is determined depending on whether the detection pin 208 contacts or not any of mechanical contacts which is provided below the detection pin 208. Further alternatively, the depth may be measured by means of an existing displacement sensor such as a pressure sensor, laser, or magnetic circuit.

The DC operating voltage may be specified not by the length of the regulation pin 108 but by the shape thereof. In this case, for example, the DC operating voltage may be specified by the number of protrusions provided at the distal end of the regulation pin 108. Alternatively, the DC operating voltage may be specified by the material of the regulation pin 108. In this case, for example, the DC operating voltage may be specified by the light transmissibility or electric resistivity of the regulation pin 108.

The configuration in which the length of the regulation pin 108 is increased for higher DC operating voltage is for safety reasons. In the case where it is assumed that the regulation pin 108 corresponding to a DC operating voltage of 5 (V) has a length longer enough to make the lowermost depth sensor 216*d* react, the following problem may occur. In this case, the depth sensors 216*a*, 216*b*, 216*c*, and 216*d* correspond respectively to 24 (V), 16 (V), 12 (V), and 5 (V). When the long regulation pin 108 corresponding to a DC operating voltage of 5 (V) is inserted into the receiving portion 202, the lowermost depth sensor 216*d* reacts, whereby the DC operating voltage of 5 (V) is supplied from the plug receiver 200.

However, at the stage when the plug-in unit 102 is inserted slightly, only the depth sensor 216*a* (24 (V)) reacts. This causes a DC operating voltage of 24 (V) to be temporarily supplied to an electronic device 400 operating at a DC operating voltage of 5 (V).

Further, when the plug-in unit 102 is pulled slightly, the depth sensor 216*d* stops reacting while the depth sensors 216*a* to 216*c* react. As a result, the voltage conversion unit 206 supplies a DC operating voltage of 12 (V). That is, also when the plug-in unit 102 is pulled, a DC operating voltage of 12 (V) is unintentionally temporarily supplied to an electronic device 400 operating at a DC operating voltage of 5 (V). Further, when only the depth sensor 216*a* reacts while the plug-in unit 102 is being pulled out, 24 (V) is supplied and when the plug-in unit 102 is fully pulled out, the supplied voltage is reduced to 0 (V). That is, a large voltage change from 24 (V) to 0 (V) occurs around the hollow portion 218, which may cause arc discharge.

By increasing the length of the regulation pin 108 for higher DC operating voltage, as in the first embodiment, the abovementioned problem does not occur. Here, it is assumed that the regulation pin 108 corresponding to a DC operating voltage of 5 (V) is a short pin that can make only the depth sensor 216*a* to react and that the depth sensors 216*a*, 216*b*, 216*c*, and 216*d* correspond respectively to 5 (V), 12 (V), 16 (V), and 24 (V).

When the plug-in unit 102 is inserted slightly, only the depth sensor 216*a* (5 (V)) reacts. Thus, a DC operating voltage of 5 (V) is supplied to an electronic device 400 operating at a DC operating voltage of 5 (V). Since the regulation pin 108 is short, the depth sensors 216*b* to 216*d* do not react.

When the plug-in unit 102 is pulled slightly, the depth sensor 216*a* that was reacting alone stops reacting, so that supply of the DC operating voltage to the electronic device 400 is stopped. A voltage change at this time is small (from (V) to 0 (V)), so that there is little possibility of occurrence of arc discharge.

Figure 4:
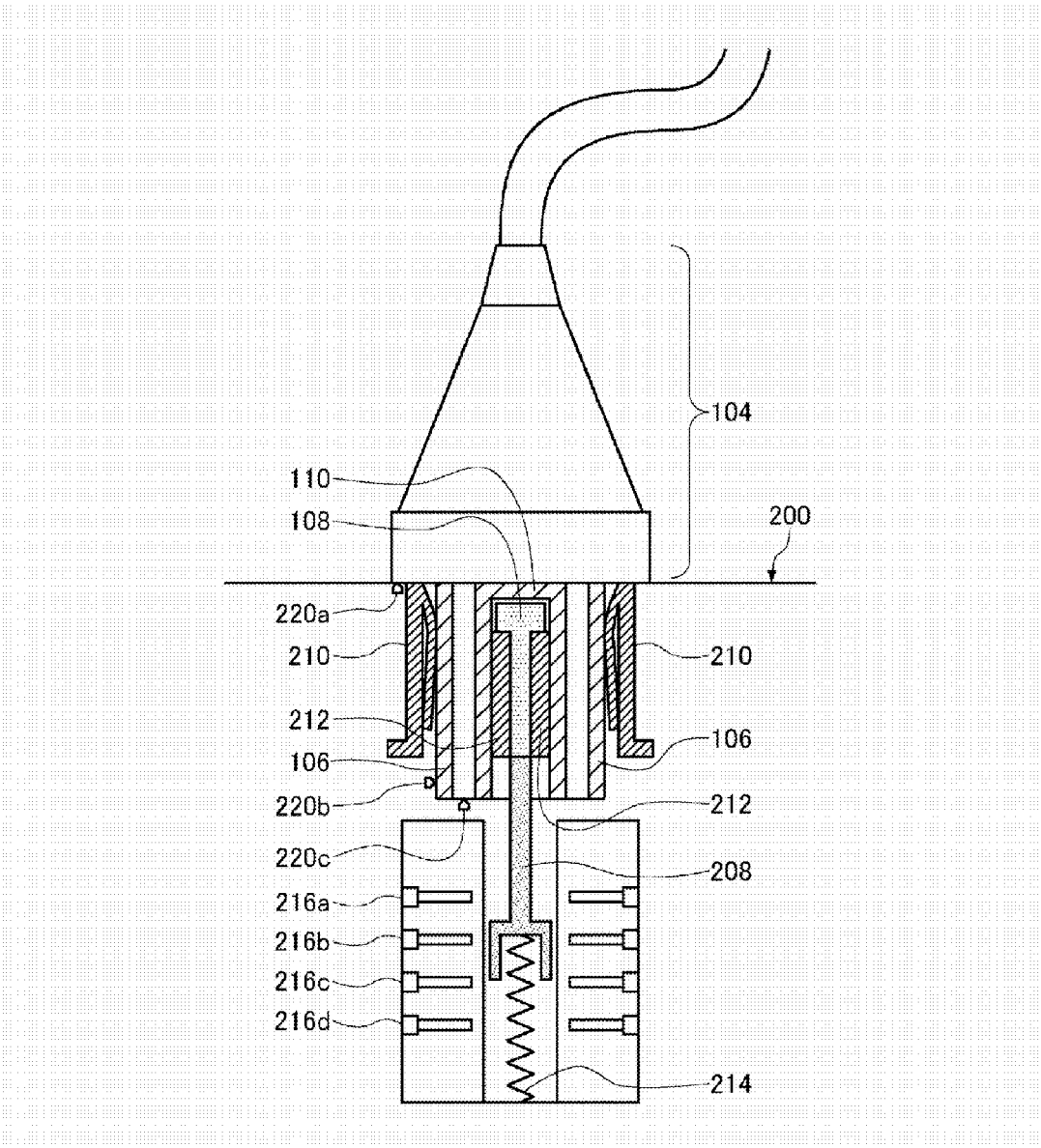
FIG. 4 is a side cross-sectional view illustrating a connection portion between the plug and plug receiver of FIG. 2 in a state where the plug of has been inserted into the plug receiver.

FIG. 4 is a side cross-sectional view illustrating a connection portion between the plug 100 and plug receiver 200 in a state where the plug 100 has been inserted into the plug receiver 200 according to the first embodiment. In FIG. 4, the lower portion of the detection pin 208 pushed by the regulation pin 108 has reached around the depth sensor 216*c*. Thus, the depth sensors 216*a* to 216*c* transmit the detection signals to the voltage identification unit 204. The voltage identification unit 204 identifies that the DC operating voltage is 16 (V) based on the detection signal of the depth sensor 216*c* with which a DC voltage of 16 (V) is associated.

Contact sensors 220*a* to 220*c* may be provided. The contact sensor 220*a* transmits a contact signal to the voltage identification unit 204 when the grip unit 104 is brought into contact therewith. The contact sensor 220*b* and contact sensor 220*c* transmit the contact signal to the voltage identification unit 204 when the plug-in unit 102 is brought into contact therewith. The voltage identification unit 204 determines that the plug 100 has fully been inserted into the plug receiver 200 when receiving one or more of the above contact signals and notifies the voltage conversion unit 206 of the determination result. The voltage conversion unit 206 supplies the DC operating voltage to the plug 100 under the condition that an affirmative determination is made. According to such a configuration, the DC operating voltage is not supplied when the plug 100 is insufficiently inserted, thus increasing the safety of the wiring plug-in connector 300.

The same can be said for when the plug 100 is pulled out of the plug receiver 200. When the plug 100 is pulled even a little and the voltage identification unit 204 stops receiving the contact signal, the voltage conversion unit 206 may stop the supply of the DC operating voltage.

Figure 5:
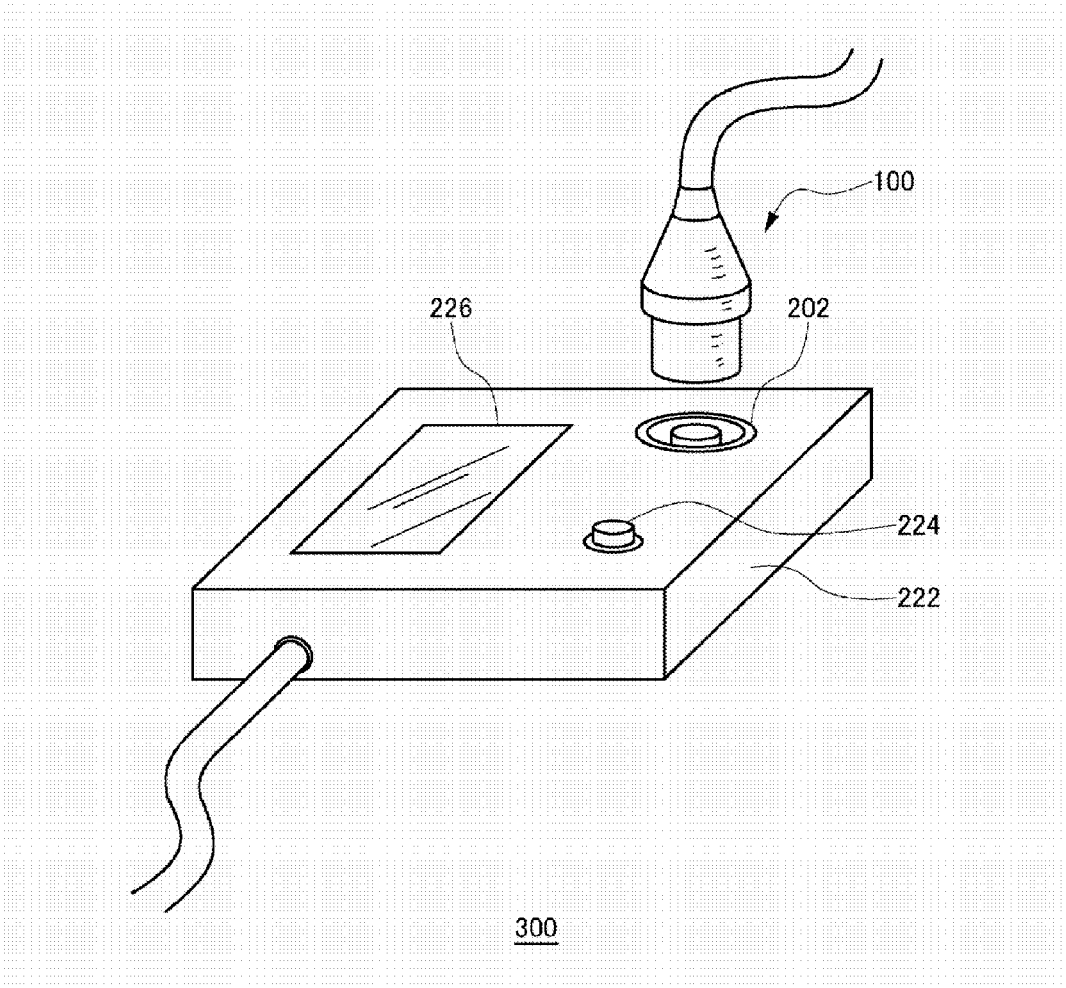
FIG. 5 is a view illustrating the outer appearance of a plug receiver according to a modification of the present embodiment.

FIG. 5 is a view illustrating the outer appearance of a plug receiver 222 according to a modification of the first embodiment. The plug receiver 222 of FIG. 5 is a power strip type. The plug receiver 222 of FIG. 5 includes a determination button 224 and a voltage indicator 226 in addition to the receiving portion 202 described above. When the plug 100 is inserted into the receiving portion 202, the DC operating voltage is displayed on the voltage indicator 226. This DC operating voltage indicates a value determined from the length of the regulation pin 108 incorporated in the plug 100. A user confirms the DC operating voltage on the voltage indicator 226 and depresses the determination button 224. The plug receiver 222 supplies the DC operating voltage from the receiving portion 202 to plug 100 under the condition that the determination button 224 has been depressed. The configuration in which the plug receiver 222 supplies DC operating voltage after receiving the user's approval further increases the safety of the wiring plug-in connector 300.

Figure 6:
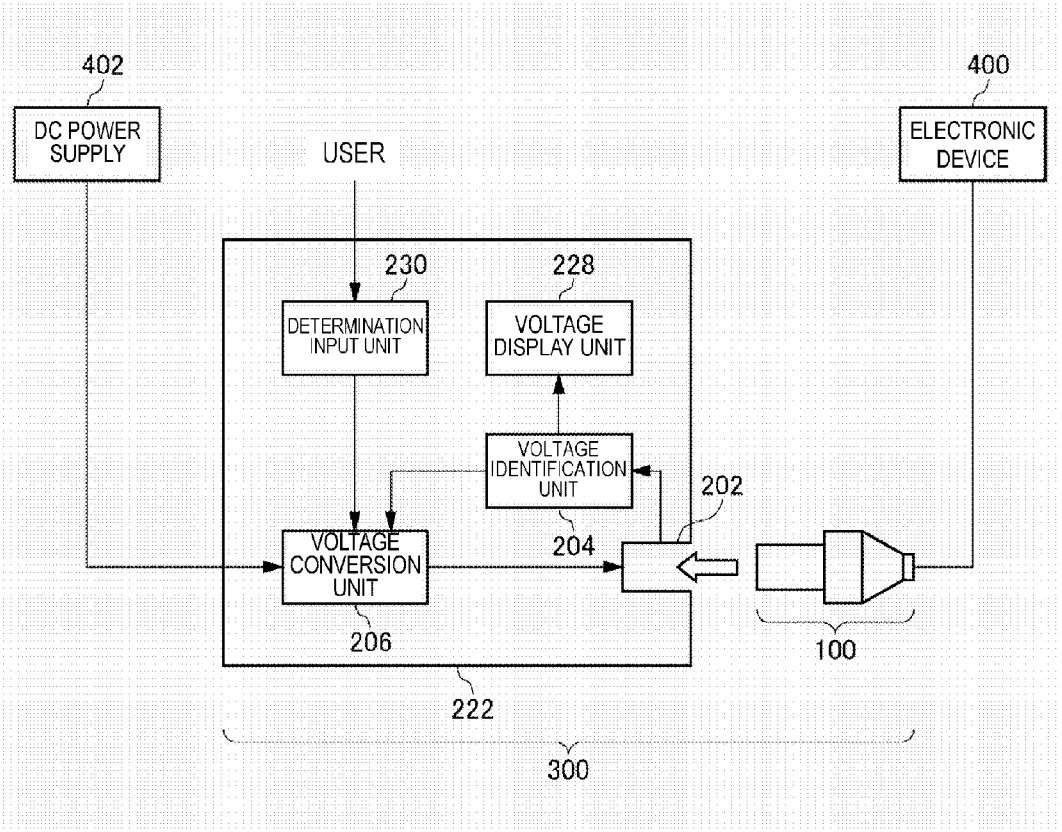
FIG. 6 is a system configuration view of a wiring plug-in connector including the plug receiver of FIG. 5.

FIG. 6 is a system configuration view of the wiring plug-in connector 300 including the plug receiver 222 of FIG. 5. The plug receiver 222 additionally includes a voltage display unit 228 and a determination input unit 230. The voltage identification unit 204 identifies the DC operating voltage when the plug 100 is inserted into the receiving portion 202 and notifies the voltage display unit 228 of the identified DC operating voltage. The voltage display unit 228 makes the voltage indicator 226 to display the DC operating voltage. When a user confirms the DC operating voltage and depresses the determination button 224, the determination input unit 230 detects the user's depression and notifies the voltage conversion unit 206 of the corresponding information. The voltage conversion unit 206 receives the notification of the depression of the determination button 224 and starts supplying the DC operating voltage identified by the voltage identification unit 204 to the plug 100.

Second Embodiment

Figure 7:
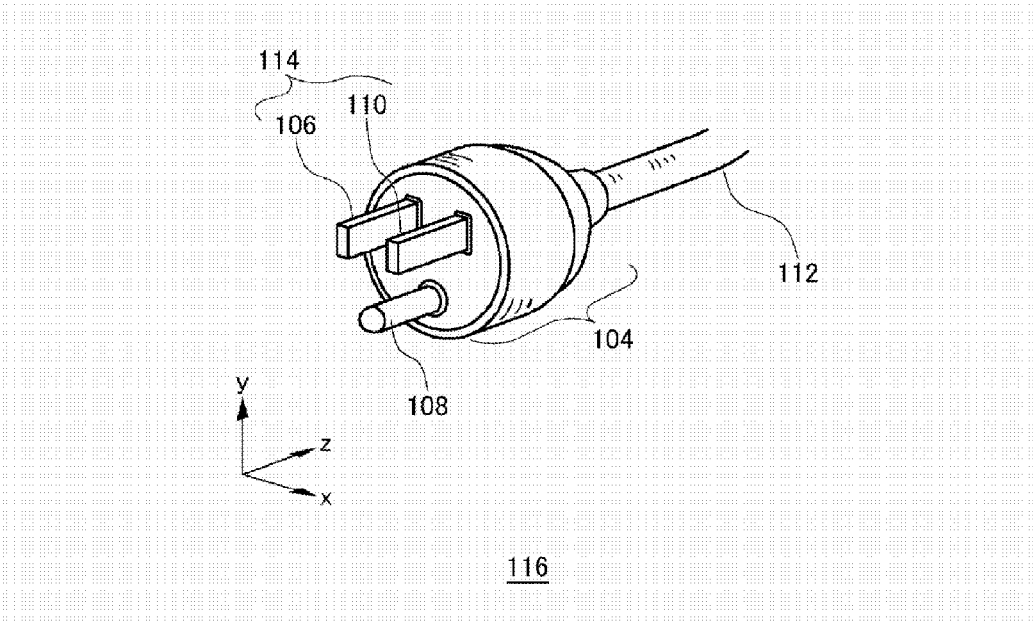
FIG. 7 is a view illustrating the outer appearance of a plug of a different type.

FIG. 7 is a view illustrating the outer appearance of a plug 116 according to the second embodiment. The plug 116 is also connected to the electronic device 400 by the cord 112 extending from the grip unit 104. The plug 116 includes a positive terminal 110 and a negative terminal 106. The positive and negative terminals 110 and 106 of the plug 116 are each a flat metal terminal. The positive and negative terminals 110 and 106 constitute an electrode pin 114.

The plug 116 includes a columnar regulation pin 108 in addition to the electrode pin 114. The regulation pin 108 also specifies the DC operating voltage by the length of the z-axis. The regulation pin 108 is exchangeable. Therefore, an adequate regulation pin 108 may be selected in accordance with the DC operating voltage of the electronic device 400. The insertion direction of the plug 116 is defined by the two electrode pins 114 and one regulation pin 108.

The distance between the positive and negative terminals 110 and 106 according to the second embodiment is large in the plug 116 than in the plug 100 of FIG. 2. This makes it difficult for the positive and negative terminals 110 and 106 to be short-circuited, so that high voltage is more easily handled than in the plug 100 of FIG. 2. The regulation pin 108 can be made to function also as an earth terminal (ground pin).

Figure 8:
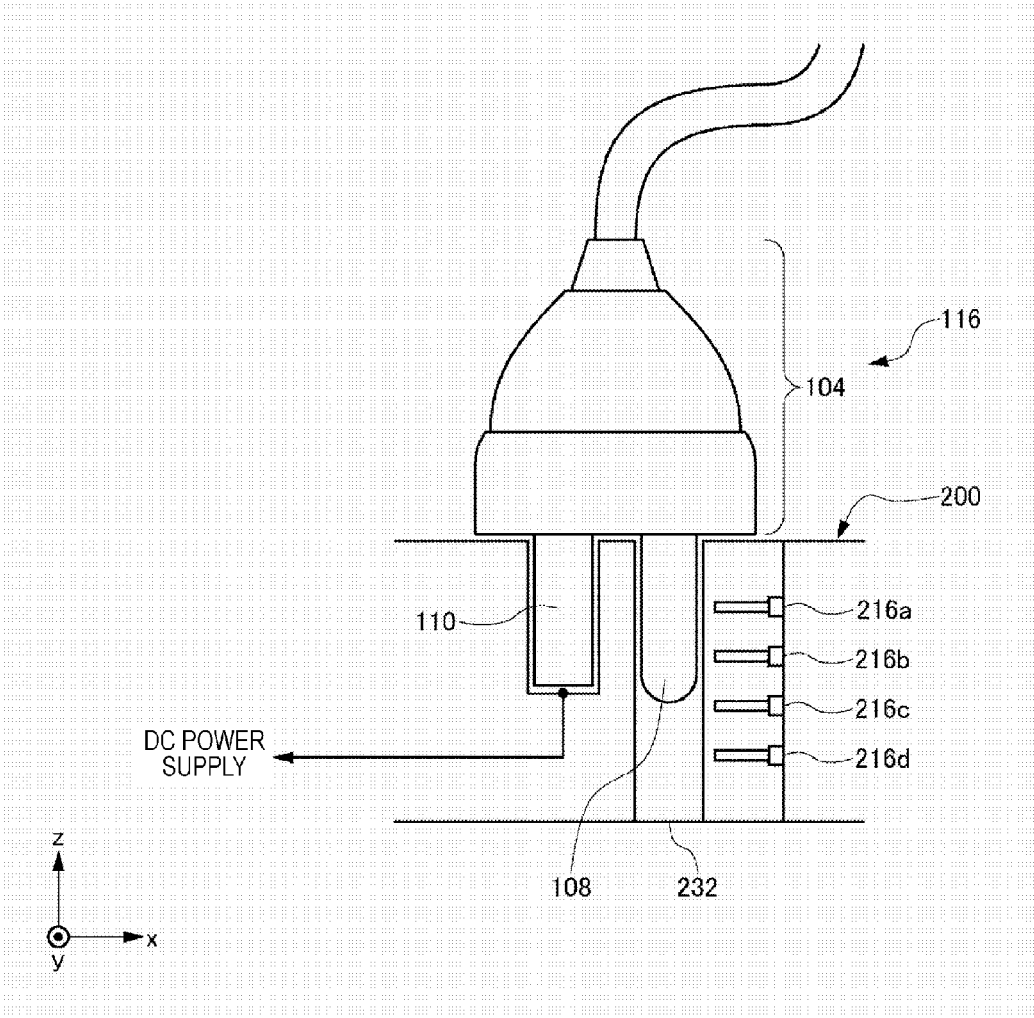
FIG. 8 is a side cross-sectional view illustrating a connection portion between the plug and plug receiver of FIG. 7 in a state where the plug has been inserted into the plug receiver.

FIG. 8 is a side cross-sectional view illustrating a connection portion between the plug 116 and plug receiver 200 in a state where the plug 116 has been inserted into the plug receiver 200. When the plug 116 is inserted into the plug receiver 200, the positive terminal 110 and negative terminal 106 are connected to not-illustrated negative electrode and positive electrode, whereby the DC operating voltage is supplied to the electronic device 400. The plug receiver 200 includes a regulation pin jack 232 for receiving the regulation pin 108. A plurality of depth sensors 216 (photoelectric sensors) are arranged along the regulation pin jack 232. When the regulation pin 108 passes through the depth sensor 216*a*, the depth sensor 216*a* transmits a detection signal to the voltage identification unit 204. The longer the regulation pin 108 is, the more number of depth sensors 216 react.

In the wiring plug-in connector 300 of FIG. 8, when only the depth sensor 216*a* transmits a detection signal, the voltage identification unit 204 identifies that the DC operating voltage is 30 (V). When the depth sensor 216*b* also transmits a detection signal, the voltage identification unit 204 identifies that the DC operating voltage is 50 (V). When the depth sensor 216*c* also transmits a detection signal, the voltage identification unit 204 identifies that the DC operating voltage is 80 (V). When the depth sensor 216*d* also transmits a detection signal, the voltage identification unit 204 identifies that the DC operating voltage is 100 (V). Also in the case of the plug 116, the DC operating voltage is identified by the length of the regulation pin.

Figure 9:
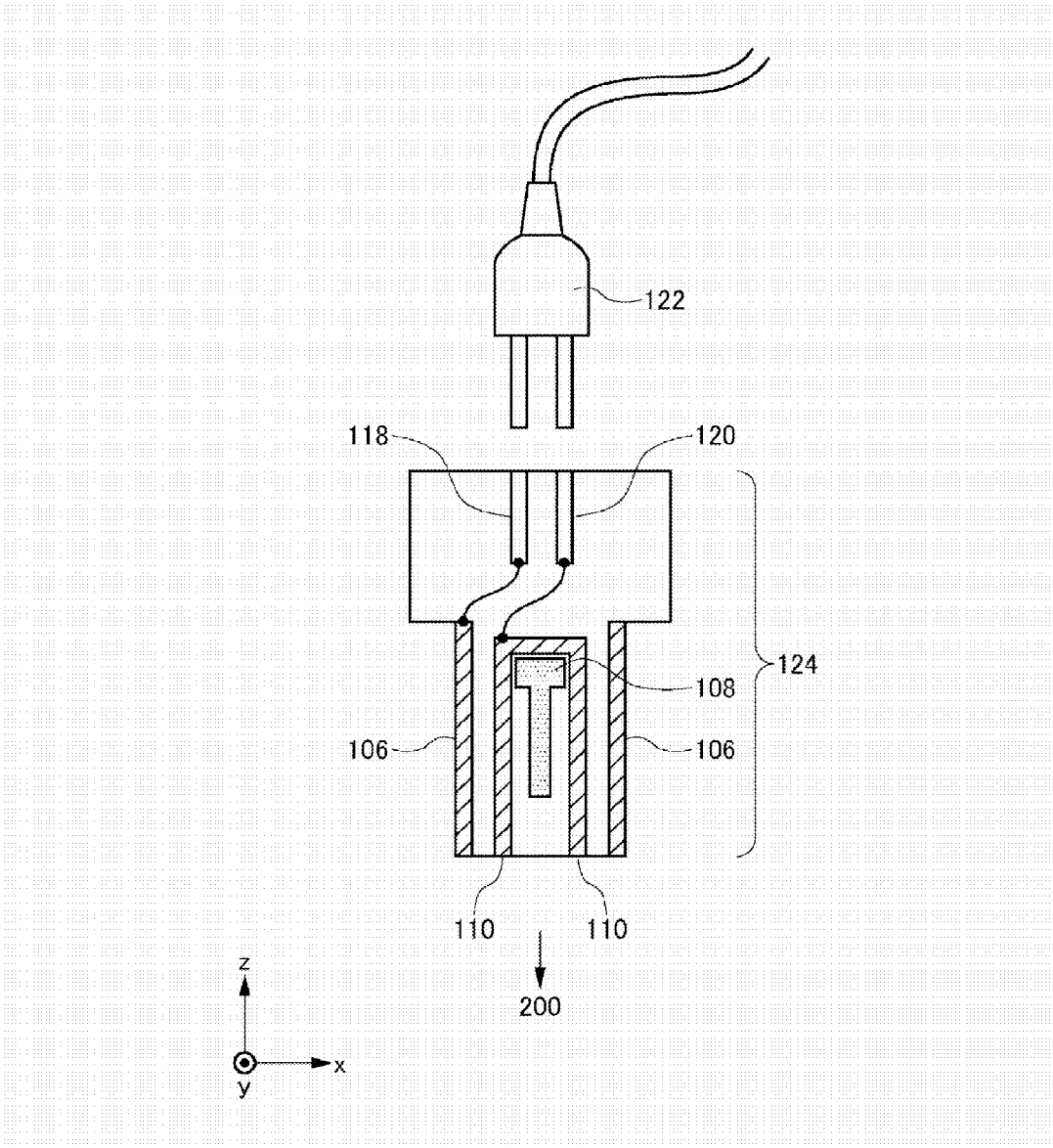
FIG. 9 is a side cross-sectional view of a conversion plug for the plug of FIG. 2.

FIG. 9 is a side cross-sectional view of a conversion plug 124 for the plug 100 of the first embodiment. In the case of an electronic device 400 provided with a general AC plug 122, there may be a case where the AC plug 122 cannot be replaced with the DC voltage plug 100. In this case, the electronic device 400 and plug receiver 200 can be connected through the conversion plug 124.

The conversion plug 124 includes a first jack 118 and a second jack 120, into which the pins of the existing AC plug 122 are inserted. The conversion plug 124 includes a negative terminal 106, a positive terminal 110, and a regulation pin 108 which have the same configurations as those in the plug 100. The first jack 118 is connected to the negative terminal 106, and second jack 120 is connected to the positive terminal 110.

The conversion plug 124 supplies the DC operating voltage supplied from the plug receiver 200 to the AC plug 122. The conversion plug 124 eliminates the mismatch between the pin shape of the AC plug 122 and shape of the receiving portion 202 of the plug receiver 200, allowing the existing AC plug 122 to utilize the plug receiver 200.

Figure 10:
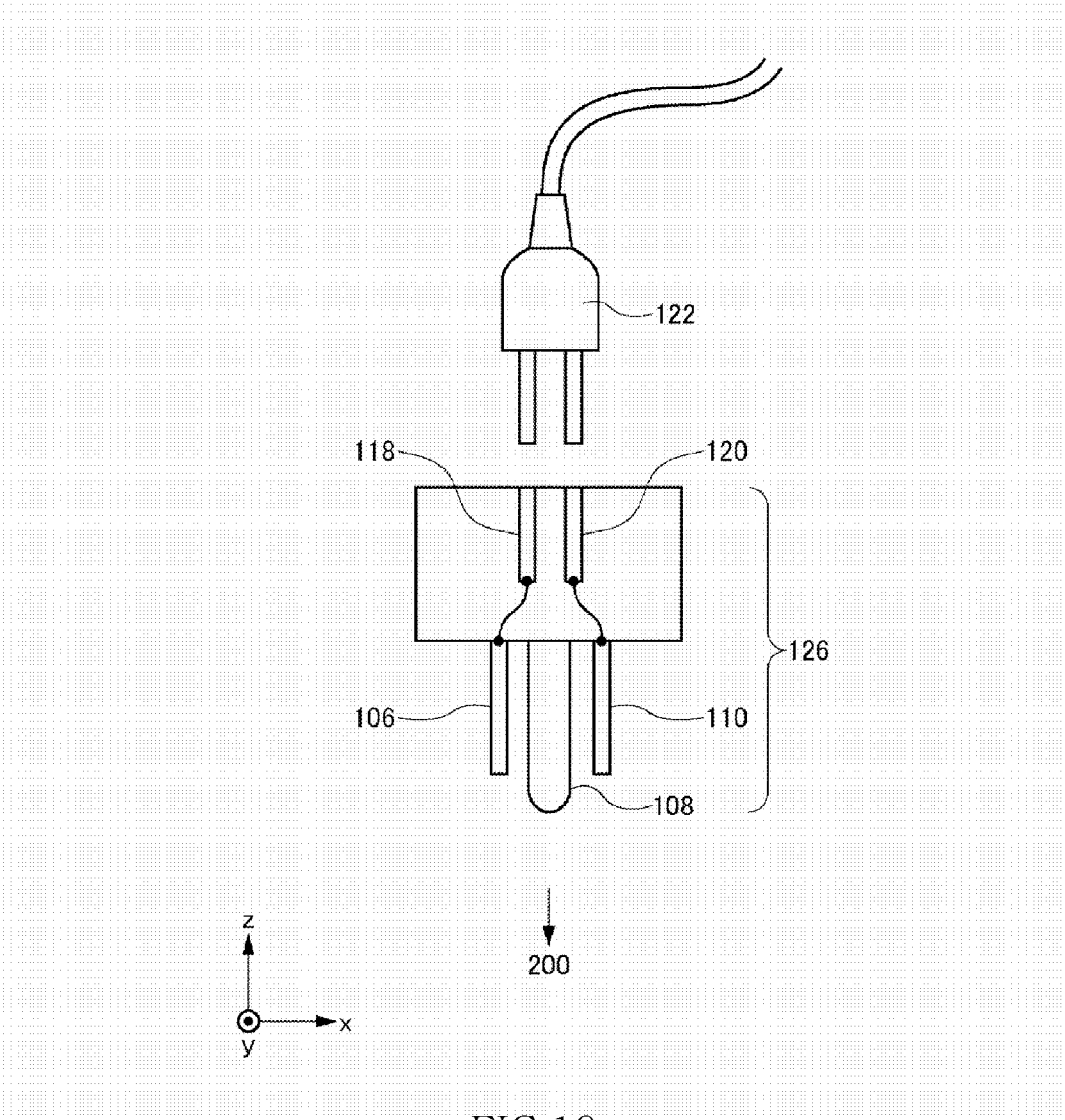
FIG. 10 is a side cross-sectional view of a conversion plug for the plug of FIG. 7.

FIG. 10 is a side-cross sectional view of a conversion plug 126 for the plug 116 of the second embodiment. The conversion plug 126 can convert a general AC plug 122 into the plug 116. The conversion plug 126 includes a first jack 118 and a second jack 120, into which the pins of the existing AC plug 122 are inserted. The conversion plug 126 includes a negative terminal 106, a positive terminal 110, and a regulation pin 108 which have the same configurations as those in the plug 116. The first jack 118 is connected to the negative terminal 106, and second jack 120 is connected to the positive terminal 110.

Third Embodiment

Figure 11:
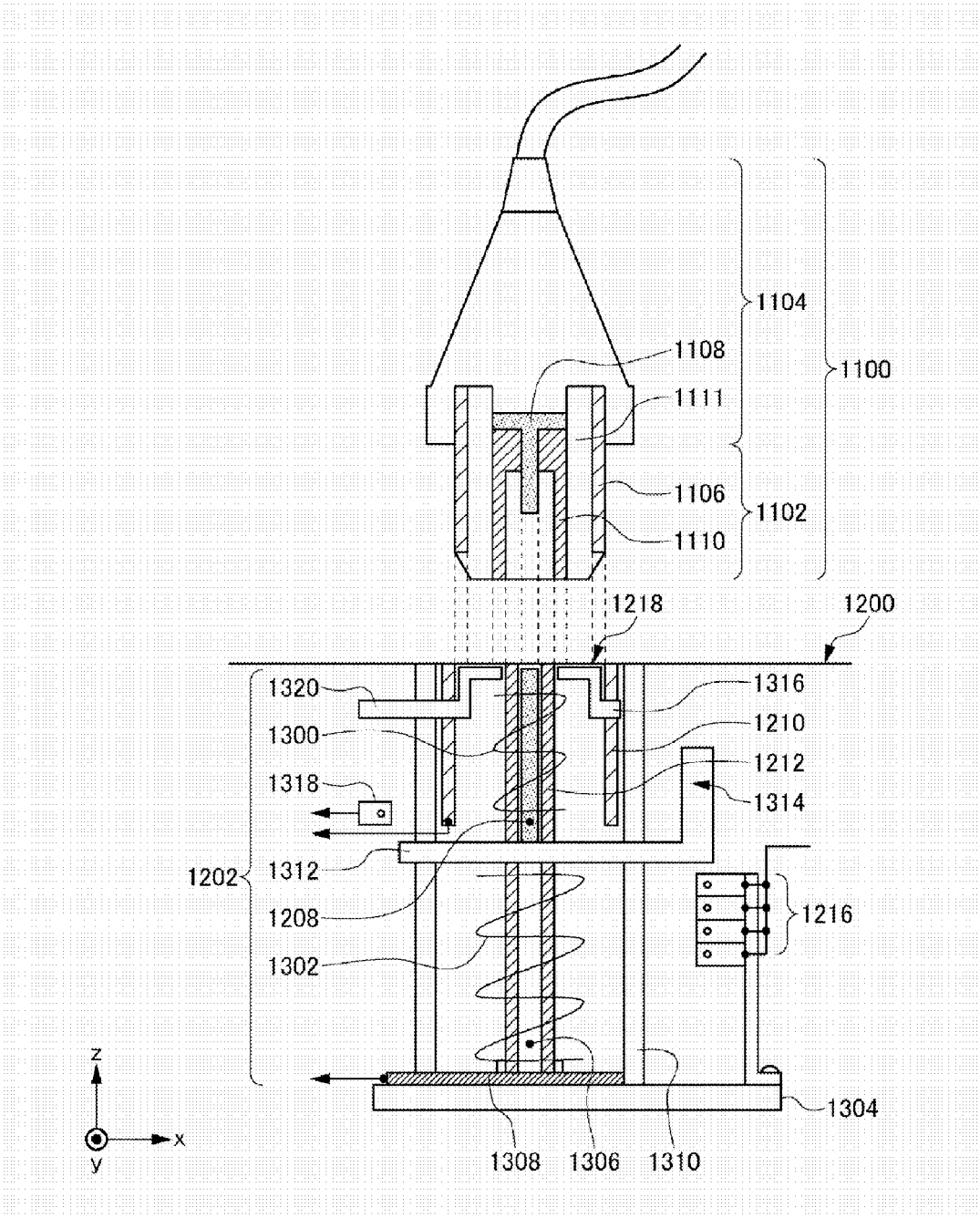
FIG. 11 is a side cross-sectional view according the third embodiment, illustrating a connection portion between the plug and plug receiver in a state before the plug is inserted into the plug receiver.

FIG. 11 is a side cross-sectional view illustrating a connection portion between the plug 1100 and plug receiver 1200 in a state before the plug 1100 is inserted into the plug receiver 1200 according to the third embodiment. The system configuration of the wiring plug-in connector 300 according to the third embodiment is the same as that in FIG. 1 in principal. The setting of the regulation pin 1108 of the third embodiment is different from that of the first embodiment, but the detail is described with FIG. 12. The outer appearance of the plug 1100 is the same as that of the plug 100 of the first embodiment in principal.

The plug 1100 includes plug-in unit 1102 and a grip unit 1104. When the plug-in unit 1102 is inserted into a receiving portion 1200 (insertion region) of the plug receiver 1200, an electrical path is established between the DC power supply 402 and electronic device 400, whereby the DC operating voltage is supplied to the electronic device 400.

The plug-in unit 1102 includes a positive terminal 1110 and a negative terminal 1106. The positive terminal 1110 and negative terminal 1106 are each a cylindrical metal terminal and have a concentric shape. The negative terminal 1106 has a larger diameter than the positive terminal 1110. The positive terminal 1110 may be provided outside the negative terminal 1106. The positive and negative terminals 1110 and 1106 constitute an electrode pin. The positive terminal 1110 is insulated from the negative terminal 1106 by the guide pipe 1111. The detail of the guide pipe 1111 will be described with reference to FIG. 12.

The regulation pin 1108 of the third embodiment is made of in-conductive resin. The regulation pin 1108 may be made of another material such as metal. The regulation pin 1108 specifies the DC operating voltage by the length of the z-axis. The receiving portion 1202 of the plug receiver 1200 includes a hollow portion 1218, and the plug-in unit 1102 of the plug 1100 is inserted into the hollow portion 1218. A negative electrode 1210 and a positive electrode 1212 are formed outside and inside the hollow portion 1218, respectively.

A substrate 1304 is provided in the bottom of the plug receiver 1200. An internal-electrode pillar 1306 of cylinder shape is fixed on the substrate 1304. The positive electrode 1212 is set on the surface of the internal-electrode pillar 1306 and connected to a positive electrode plate 1308 on the substrate 1304. Positive DC voltage is supplied to the positive electrode plate 1308. When the plug 1100 is inserted, the internal-electrode pillar 1306 is inserted into the positive terminal 1110 and the positive electrode 1212 on the surface of the internal-electrode pillar is contact to the positive terminal 1110. As a result, the positive terminal 1212 of the plug 1110 is provided with positive DC voltage via the internal-electrode pillar 1306.

The guide pipe 1310 of cylinder shape is also fixed to the substrate 1304. The negative electrode 1210 of cylinder shape is set inside of the guide pipe 1310. Negative DC voltage is supplied to the negative electrode 1210. When the plug 1100 is inserted, the plug-in unit 1102 is inserted into the guide pipe 1310 and the negative electrode 1210 inside of the guide pipe 1310 is contacted with the negative terminal 1106. As a result, the negative terminal 1106 of the plug-in unit 1100 is supplied with negative DC voltage from the negative electrode 1210.

Further, the detection pin 1208 is inserted into the internal-electrode pillar 1306 and is movable along the z-axis. A movable component 1312 of plane shape is fixed to the detection pin 1208. The movable component 1312 is movable along the z-axis. The detection pin 1208 and the movable component 1312 are supported by a lower spring 1302 (lower elastic component). The detection pin 1208 and the movable component 1312 function as one component and the one component is supported by the lower spring 1302.

When the plug 1100 is inserted into the hollow portion 1218, the internal-electrode pillar 1306 is inserted into the positive terminal 1110 and the detection pin 1208 in the internal-electrode pillar 1306 is contacted with the regulation pin 1108. As the regulation pin 1108 pushes the detection pin in a z-axis negative direction (downward direction in FIG. 119, the movable component 1312 also moves in the z-axis negative direction. A detection portion 1314 at the end of the movable component 1312 protrudes outside of the hollow portion 1218, more specifically protrudes in the x-axis direction. Around the passing area (movable region in the z-axis direction) of the detection portion 1314, a plurality of depth sensors 1216 (Photoelectric sensors) are provided. The longer the regulation pin 1108 is, the deeper the movable component 1312 is pushed down. As same as the first embodiment, the DC operating voltage is identified based on the detection signals from these depth sensors 1216. It is not necessary that the detection portion 1314 is the end of the movable component 1312. At least, the detection portion 1314 is part of the movable pin 1312, the part is positioned outside the detection pin 1208.

A cover cap 1316 is set at the jack of the plug receiver 1200. The cover cap 1316 is movable along the z-axis direction and is put on the movable component 1312 supported by the upper spring 1300 (upper elastic component). When the plug 1100 is inserted into the hollow portion 1218, the plug-in unit 1102 pushes down the cover cap 1316. When the plug 1100 is inserted completely, the check sensor 1318 (Photoelectric sensor) detects a protrusion 1320 of the cover cap 1316 passing through. The complete insertion of the plug 1100 is confirmed according to the detection signal from the check sensor 1318. The upper spring 1300 has an elasticity by which the cover cap is settled at a predetermined position when the plug 1100 is not inserted. The elasticity of the upper spring 1300 is smaller than that of the lower spring 1302 such that the check sensor 1318 detects the protrusion 1320 of the cover cap 1316 before the detection portion 1314 of the movable component 1312 is detected by the depth sensors 1216. The upper spring 1300 may be fixed to the movable plate 1312. Alternately, the upper spring 1300 may be fixed to or put on the guide pipe 1310. For example, a part of internal surface of the guide pipe 1310 may protrude toward the center of the guide pipe 1310 and the upper spring 1300 may be fixed to or put on the protrusion. In other words, by using apart of the guide pipe 1310 as a pedestal, the position of the upper spring 1300 may be settled.

Figure 12:
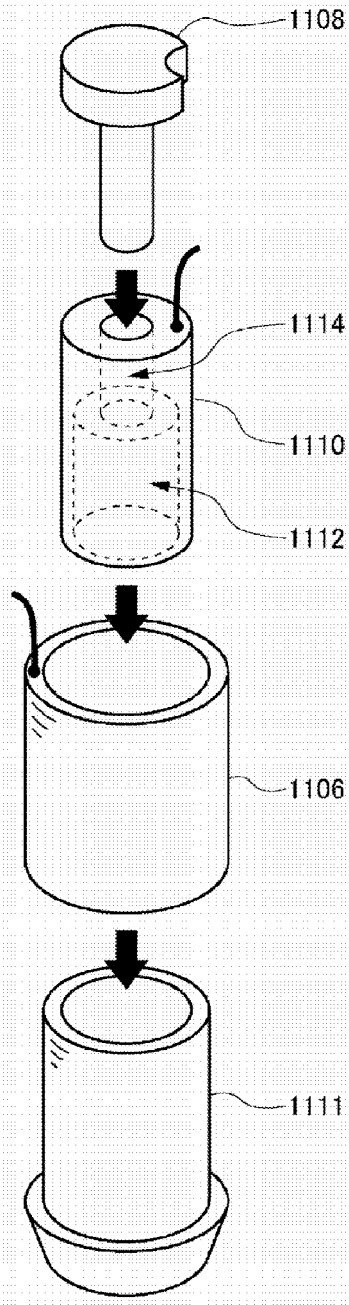
FIG. 12 is a structure view of a plug-in unit.

FIG. 12 is a structure view of a plug-in unit 1102. At first the negative terminal 1106 of cylinder shape is capped outside the guide pipe 1111 of cylinder shape. The positive terminal 1110 of cylinder shape is set inside the guide pipe 1106. As the guide pipe is made of resin, the positive terminal 1110 is insulated from the negative terminal 1106.

The positive terminal 1110 includes a first hollow portion 1112 into which the internal-electrode pillar 1306 is inserted and a second hollow portion 1114 (penetration hole) into which the regulation pin 1108 is inserted. The regulation pin 1108 with flange is inserted into the second hollow portion 1114. Electrode extracting lines are extracted from the negative terminal 1106 and the positive terminal 1110 respectively. To extract the electrode extracting line from the positive terminal 1110, the flange of the regulation pin 1108 is partially cut out.

Figure 13:
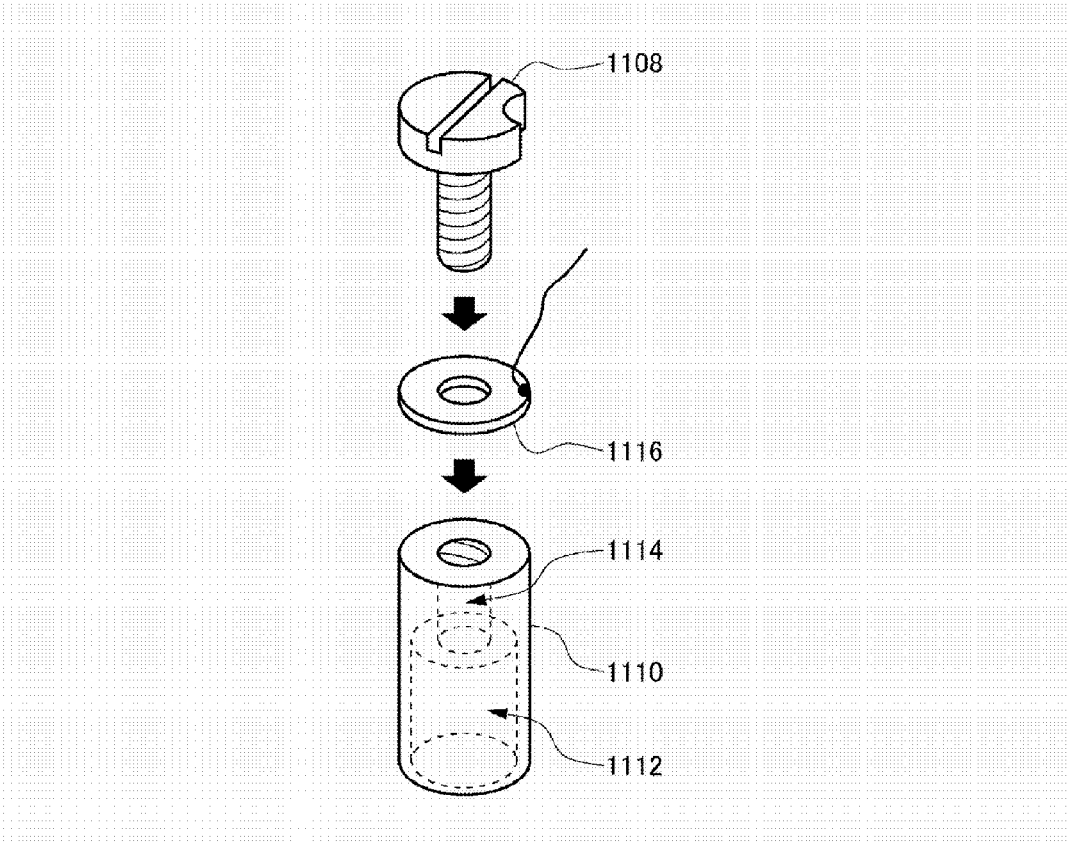
FIG. 13 is a detailed view showing the structure of a positive terminal and the regulation pin.

FIG. 13 is a detailed view showing the structure of a positive terminal 1110 and the regulation pin 1108. The regulation pin 1108 has a screw ditch. A screw ditch is also cut out inside the electrode pin 114 of the positive terminal 1110. With this screw structure, the positive terminal 1110 is more firmly fixed to the regulation pin 1108. An electrode plate in circle shape may be sandwiched between the positive electrode 1110 and the regulation pin 1108. The sandwiched electrode plate makes it easier to set the electrode extracting line. The regulation pin 1108 may be pushed into the second hollow portion 1114 without providing the screw ditch inside the second hollow portion 1114. Alternately, the positive terminal 1110 is fixed to the regulation pin 1108 with a screw which fixes the flange of the regulation pin 1108 and the positive terminal 1110.

Figure 14:
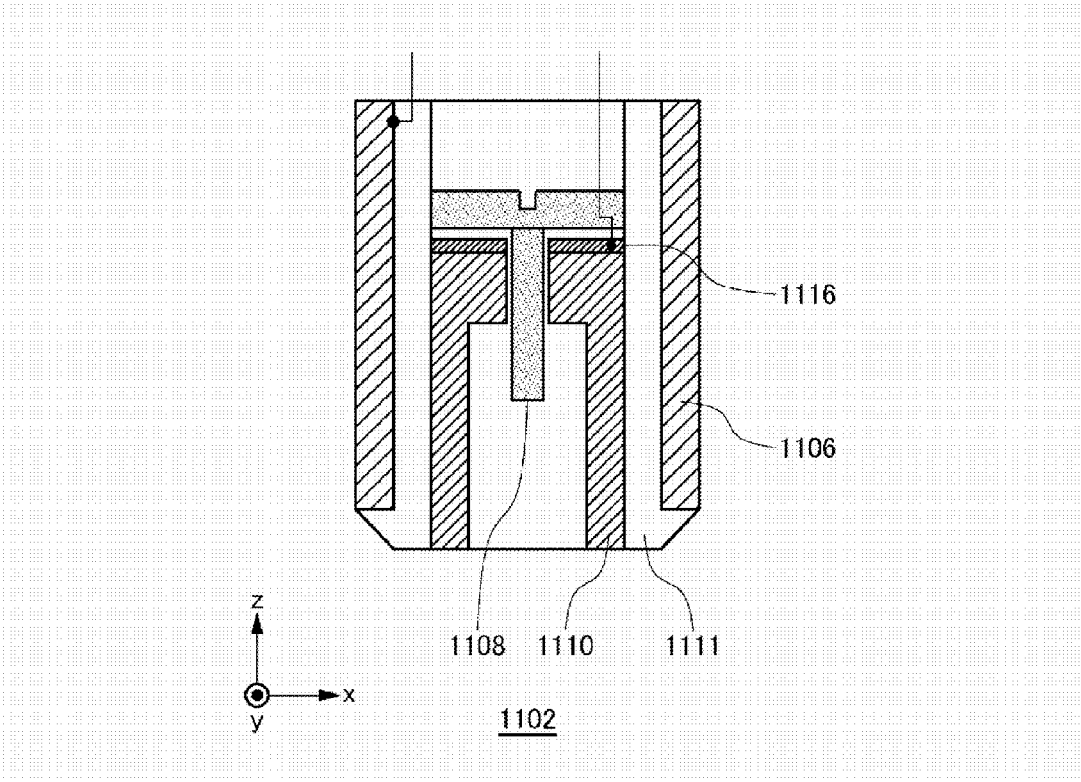
FIG. 14 is a side cross-sectional view illustrating a plug-in unit.

FIG. 14 is a side cross-sectional view illustrating a plug-in unit 1102 of FIG. 13. The upper end, a grip unit 1104 side, of the positive terminal 1110 is covered by the non-conductive regulation pin 1108. This configuration ensures insulation between the positive terminal 1110 and the negative terminal 1106.

Figure 15:
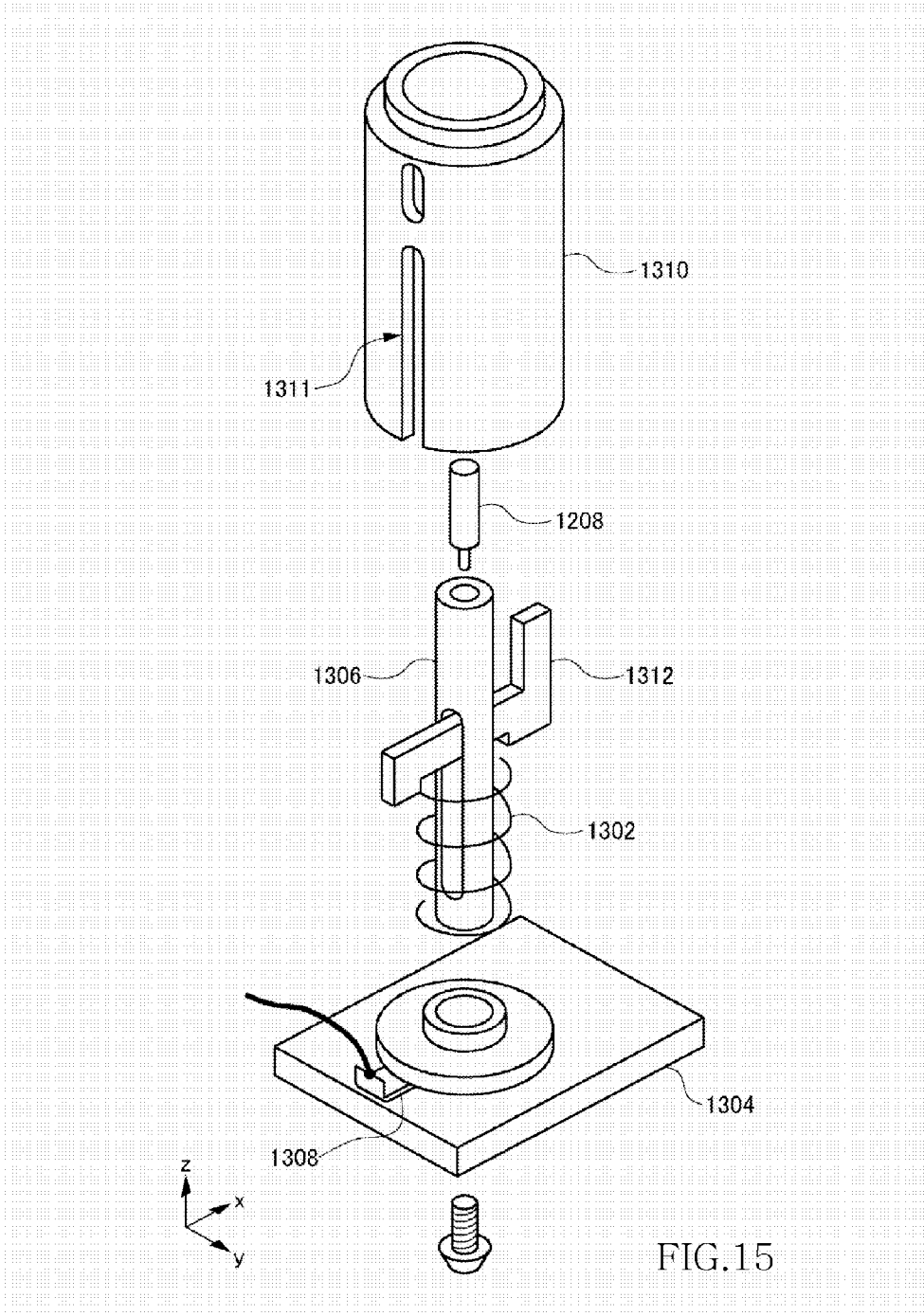
FIG. 15 is a structure view near the internal-electrode pillar in the plug receiver.

FIG. 15 is a structure view near the internal-electrode pillar 1306 in the plug receiver 1102. At first, the internal-electrode pillar 1306 is fixed to the substrate 1304 with a screw or the like. As described above, the positive electrode 1212 is put on the external surface of the internal-electrode pillar 1306. The positive electrode 1212 is connected to the positive electrode plate 1308 on the substrate 1304.

A slit is provided on the internal-electrode pillar 1306 in the z-axis direction. The movable component 1312 is set in the slit. The movable component 1312 is supported by the lower spring 1302 and is movable in the z-axis direction. A ditch to which the lower spring 1302 is fitted is provided under the movable component 1312. The lower spring 1302 is capped on a protrusion provided on the positive electrode plate 1308. With these ditch and protrusion, the lower spring 1302 is stabilized.

The internal-electrode pillar 1306 contains the detection pin 1208 and the detection pin 1208 is fixed to the movable component 1312. The internal-electrode pillar 1306, the movable component 1312, the detection pin 1208 and the like are protected by the guide pipe 1310. A slit 1311 is provided on the guide pipe 1310. The detection portion 1314 of the movable component 1314 passes along the slit 1311.

That is, the plug-in unit 1102 of the plug 1100 goes into the hollow inside the guide pipe 1310. The regulation pin 1108 in the plug-in unit 1102 contacts the detection pin 1208 in the internal-electrode pillar 1306 and the detection pin 1208 is pushed down in the z-axis negative direction. At that time, the movable component 1312 fixed with the detection pin 1208 is also pushed down in the z-axis negative direction against the elasticity of the lower spring 1302.

Figure 16:
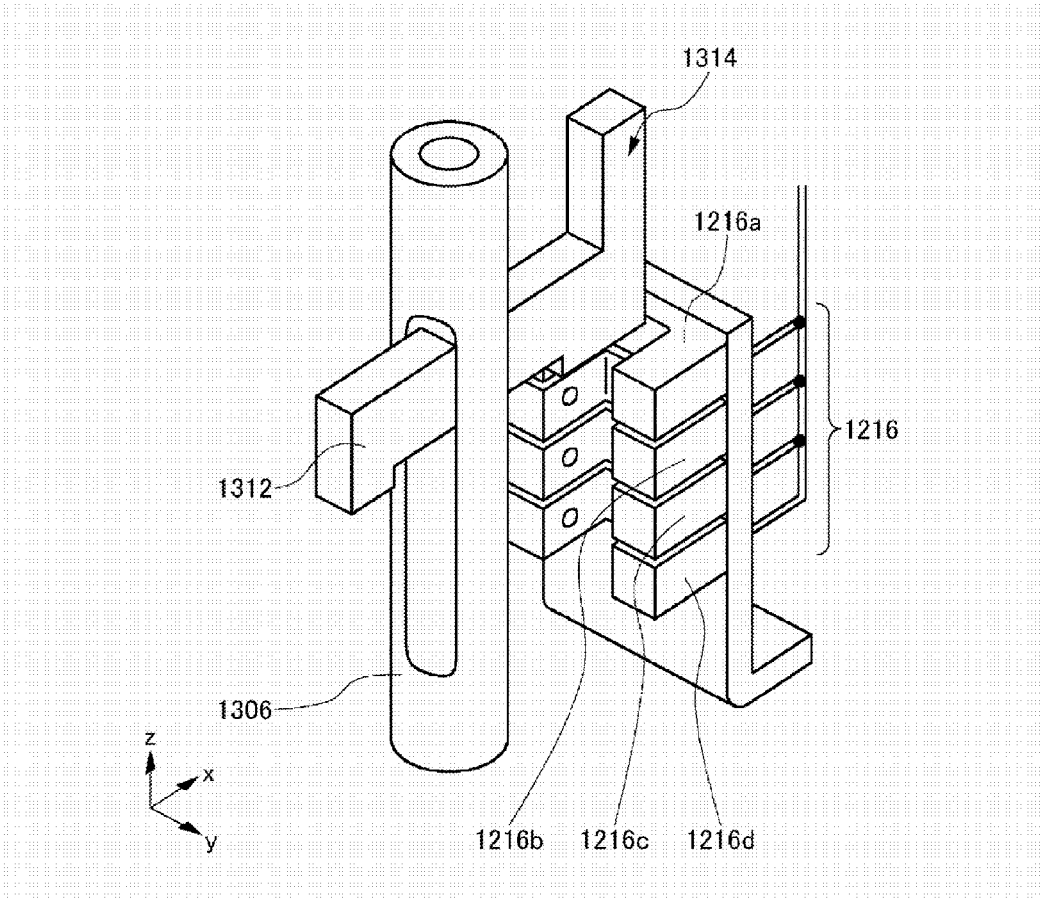
FIG. 16 is an enlarged perspective view near the detection area.

FIG. 16 is an enlarged perspective view near the detection portion 1314. When the movable component 1312 is pushed down in the z-axis negative direction, the detection portion 1314 of the movable component 1312 passes through near the depth sensors 1216. When the movable component 1312 is pushed down deeper, the depth sensors 1216*a*, 1216*b*, 1216*c* and 1216*d* starts transmitting the detection signals in this order. Each of the depth sensors 1216 keeps transmitting the detection signal while the detection portion 1314 is crossing the corresponding area.

The detection portion 1314 and the depth sensors 1216 are provided in the side of the receiving portion 1202. Consequently, the size of the receiving portion 1202 is shortened in the insertion depth direction, compared with the first embodiment. In the first embodiment, there exists a spring 214 in the detection region of the depth sensors 216. On the other hand, in the second embodiment, only the detection portion 1314 exists in the detection region of the depth sensors 1216. With this configuration, detection accuracy is improved.

In the second embodiment, when the check sensor 1318 (Photoelectric sensor) detects the cover cap 1316 passing through and any of the depth sensors 1216 (Photoelectric sensors) does not detect the detection portion 1314 passing through, 5 (V) maybe identified as DC operating voltage. When the check sensor 1318 and the depth sensor 1216*a* show detection, 12 (V) may be identified. When the check sensor 1318 and the depth sensors 1216*a* and 1216*b* show detection, 16 (V) may be identified. When the check sensor 1318 and the depth sensor 1216*a* to 1216*c* show detection, 24 (V) maybe identified. With this configuration, a check sensor 1318 and three depth sensors 1216 can identify four DC operating voltages.

Figure 17:
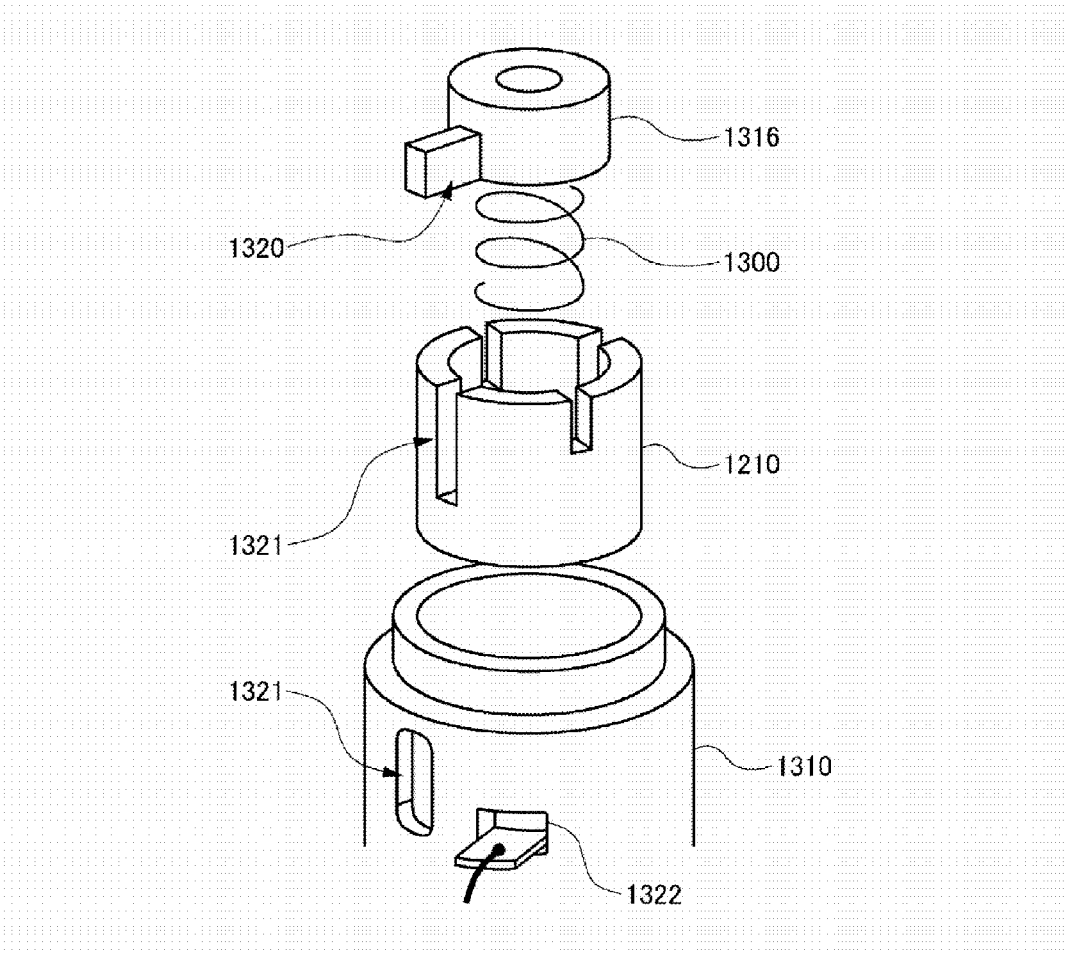
FIG. 17 is a structure view near the negative terminal in the plug receiver.

FIG. 17 is a structure view near the negative terminal 1210 in the plug receiver 200. The negative electrode 1210 of cylinder shape is inserted into the guide pipe 1310. The negative electrode 1210 is fixed to the guide pipe 1310. An electrode extraction hole 1322 is provided with the guide pipe 1310. The negative electrode 1210 is connected to a negative voltage supply via the electrode extraction hole 1322. The upper spring 1300 is inserted through the opening of the negative electrode 1210 and the cover cap 1316 is inserted on it. The upper spring 1300 is put on the movable component 1312 and the cover cap 1316 is put on the movable component 1312 via the upper spring 1300. The protrusion 1320 is provided with the cover cap 1316. The protrusion 1320 exposes through the negative electrode 1210 and the slit 1321 of the guide pipe 1310. In this configuration, the cover cap 1316 can be moved in the z-axis direction.

Figure 18:
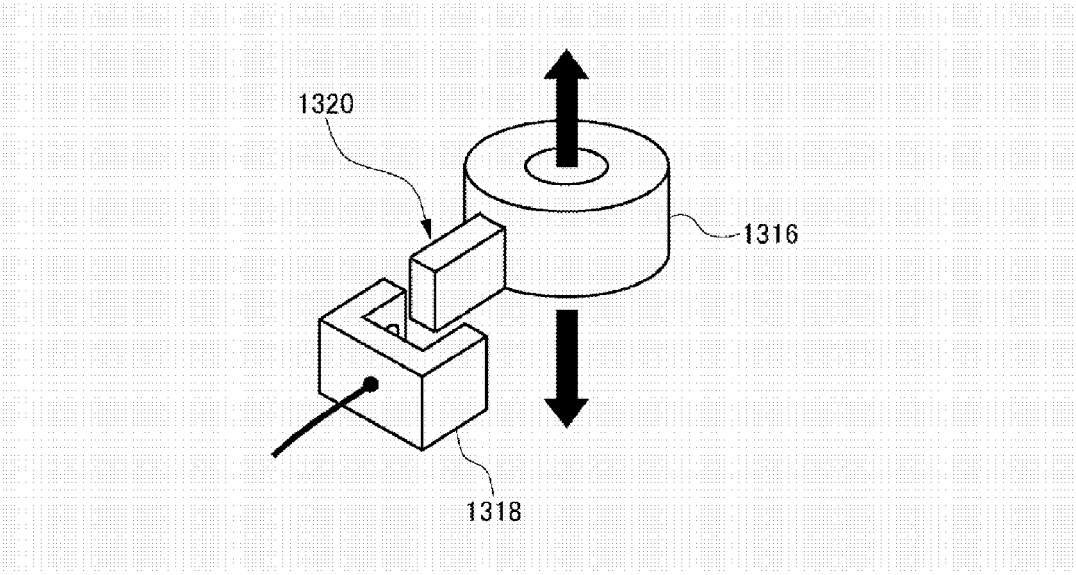
FIG. 18 is an enlarged perspective view near the protrusion of the cover cap.

FIG. 18 is an enlarged perspective view near the protrusion 1320 of the cover cap 1316. When the plug 1100 is inserted, the plug-in unit 1102 contacts and pushes down the cover cap 1316. When the plug 100 is inserted sufficiently, the protrusion 1320 passes through near the check sensor 1318. The check sensor generates a checking signal.

Figure 19:
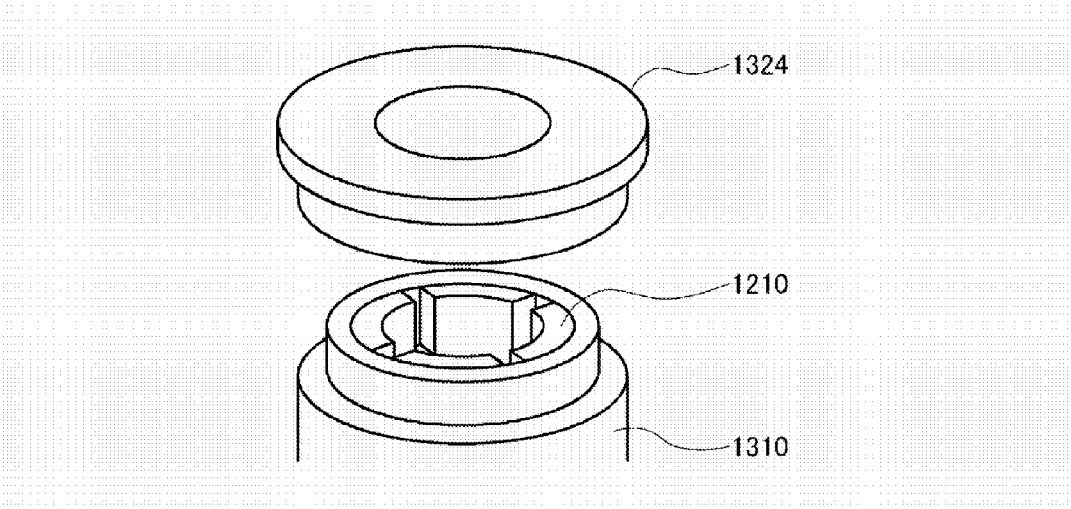
FIG. 19 is a perspective view near a consent cap in the plug receiver.

FIG. 19 is a perspective view near a consent cap 1324 in the plug receiver 1200. For concise explanation, the cover cap 1316 is not illustrated in FIG. 19. The consent cap 1324 is fitted on the guide pipe 1310 containing the negative electrode 1210. The inside diameter of the consent cap 1324 is same as that of the negative electrode 1210.

Figure 20:
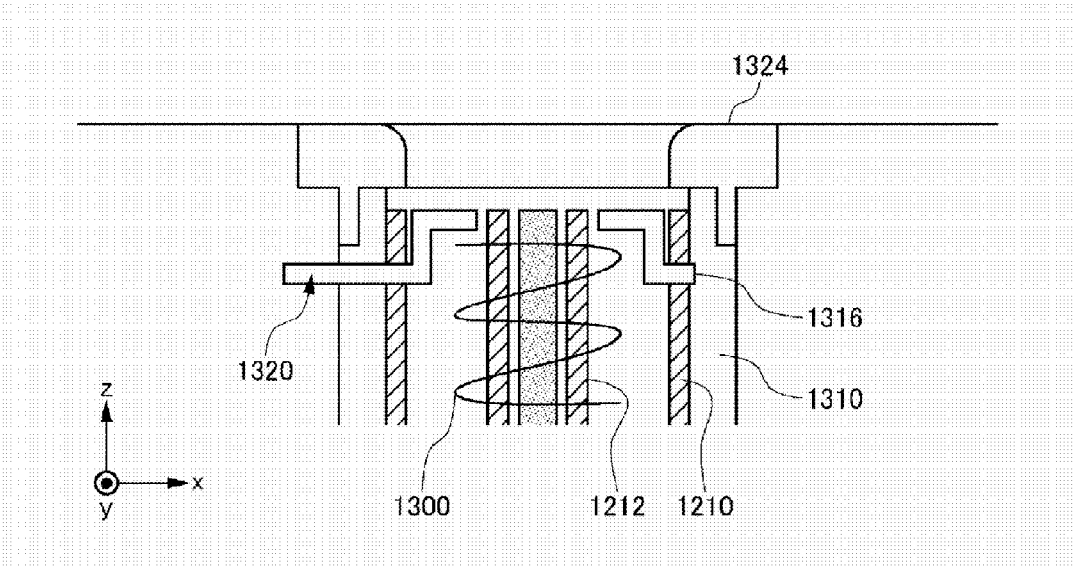
FIG. 20 is a side cross-sectional view near a consent cap in the plug receiver.

FIG. 20 is a side cross-sectional view near a consent cap 1324 in the plug receiver 1200. Though the consent cap 1324 is not shown in FIG. 11, the consent cap 1324 is set near the jack in actual. The internal corner of the consent cap 1324 is rounded off. The rounded corner guides the plug 1100 into the jack smoothly.

When the plug 1100 is inserted, the cover cap 1316 is pushed down in the z-axis negative direction by the plug-in unit 1102. The internal-electrode pillar 1306 is inserted into the positive terminal 1110 of the plug-in unit 1102.

Figure 21:
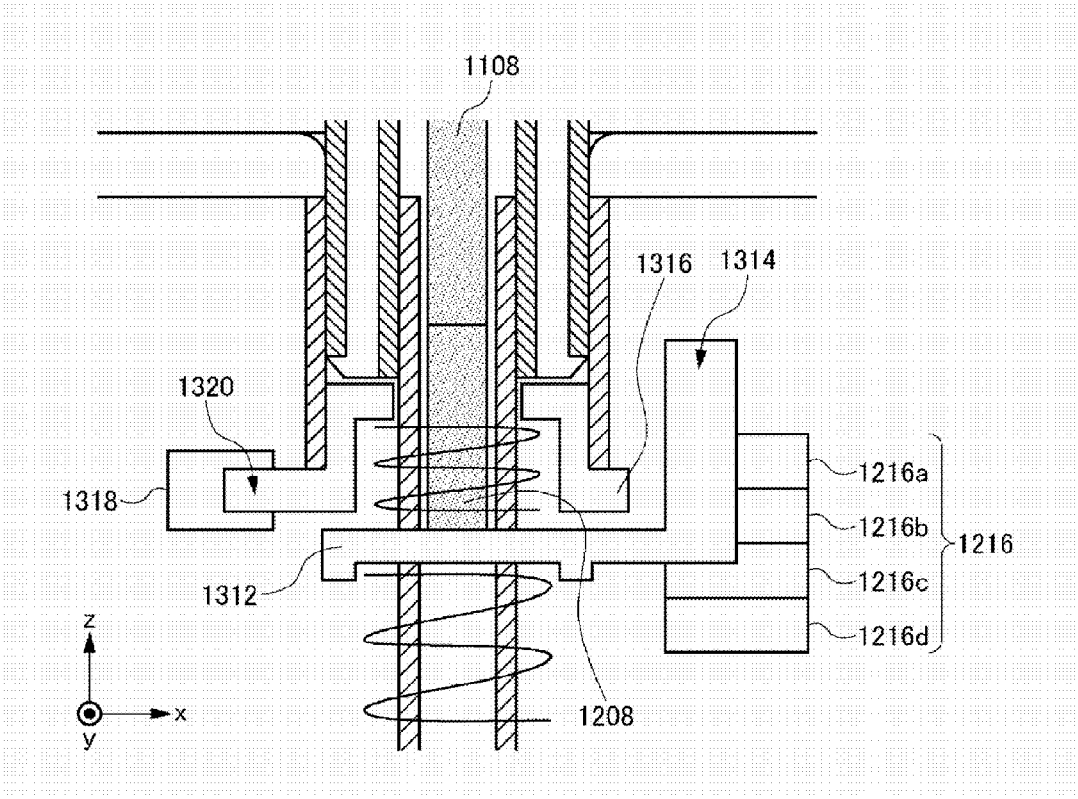
FIG. 21 is a side cross-sectional view according to the second embodiment, illustrating a connection portion between the plug and plug receiver in a state where the plug has been inserted into the plug receiver.

FIG. 21 is a side cross-sectional view according to the second embodiment, illustrating a connection portion between the plug 1100 and plug receiver 1200 in a state where the plug 1100 has been inserted into the plug receiver 1200. When the regulation pin 1108 pushes down the detection pin 1208, the movable component 1312 moves in the z-axis negative direction. The detection portion 1314 passes near the depth sensors 1216 and the depth sensor 1216 detecting the passing transmits the detection signal. The cover cap 1316 is also pushed down in the z-axis negative direction by the plug 1100. When the plug 1100 is inserted sufficiently, the protrusion 1320 of the cover cap 1316 passes near the check sensor 1318 and the check sensor 1318 detecting the passing transmits the check signal. The voltage conversion unit 206 does not supply the DC operating voltage in case the unit does not receive the check signal.

In FIG. 21, the depth sensors 1216*a* to 1216*c* generate the detection signals among the depth sensors 1216*a* to 1216*d*. The check sensor 1318 also generates the check signal. Hereafter, it is assumed as following. When only the depth sensor 1216*a* generates the detection signal, the DC operating voltage is 5 (V). When the depth sensors 1216*a* and 1216*b* generate the detection signals, the DC operating voltage is 12 (V). When the depth sensors 1216*a* to 1216*c* generate the detection signals, the DC operating voltage is 16 (V). When all of the depth sensors 1216*a* to 1216*d* generate the detection signals, the DC operating voltage is 24 (V).

When the plug 1100 is inserted into the plug receiver 1200, the depth sensors 1216*a*, 1216*b*, 1216*c*, start generating the detection signals in this order. When the check sensor 1318 generates the check signal while the depth sensors 1216*a* to 1216*c* are generating the detection signals, the voltage identification unit 204 identifies the DC operating voltage as 16 (V). However the voltage conversion unit 206 does not supply the DC operating voltage as 16 (V) to the plug 1100 in case the depth sensors 1216*a* or 1216*b* at shallower position does not generate the detection signal even though the depth sensor 1216*c* generates the detection signal, because malfunction may exists.

When the plug 1100 is pulled out while supplying the DC operating voltage as 16 (V), the depth sensor 1216*c* and the check sensor 1318 stop showing their detection. The voltage conversion unit 206 terminates the supply of the DC operating voltage immediately when the check signal is stopped even though the depth sensors 1216*a* and 1216*b* still keep generating the detection signals. With this configuration, the DC operating voltage is never supplied in a state the plug is not inserted sufficiently.

Once the check signal is stopped, the supply of the DC operating voltage never resumes before all of depth sensors 1216 stop generating the detection signals. For example, when the plug 1100 is pulled slightly but the depth sensors 1216*a* and 1216*b* keeps generating the detection signals, the voltage conversion unit 206 terminates the supply of the DC operating voltage. Even if the plug 1100 is inserted again at this state and the check sensor generates the check signal again, the voltage conversion unit 206 does not supply the DC operating voltage. Such state can be notified to a user by lightning of LED (Light Emitting Diode) which is not shown. When the plug 1100 is pulled out completely and all of depth sensors stop generating detection signals, the LED is turned off. When the plug 1100 is inserted again in this state, the supply of DC operating voltage is resumed. That is, when the plug 1100 is being pulled out, the supply of the DC operating voltage is stopped. The supply can be resumed under the condition that the plug 1100 is once pulled out completely and inserted again.

Figure 22:
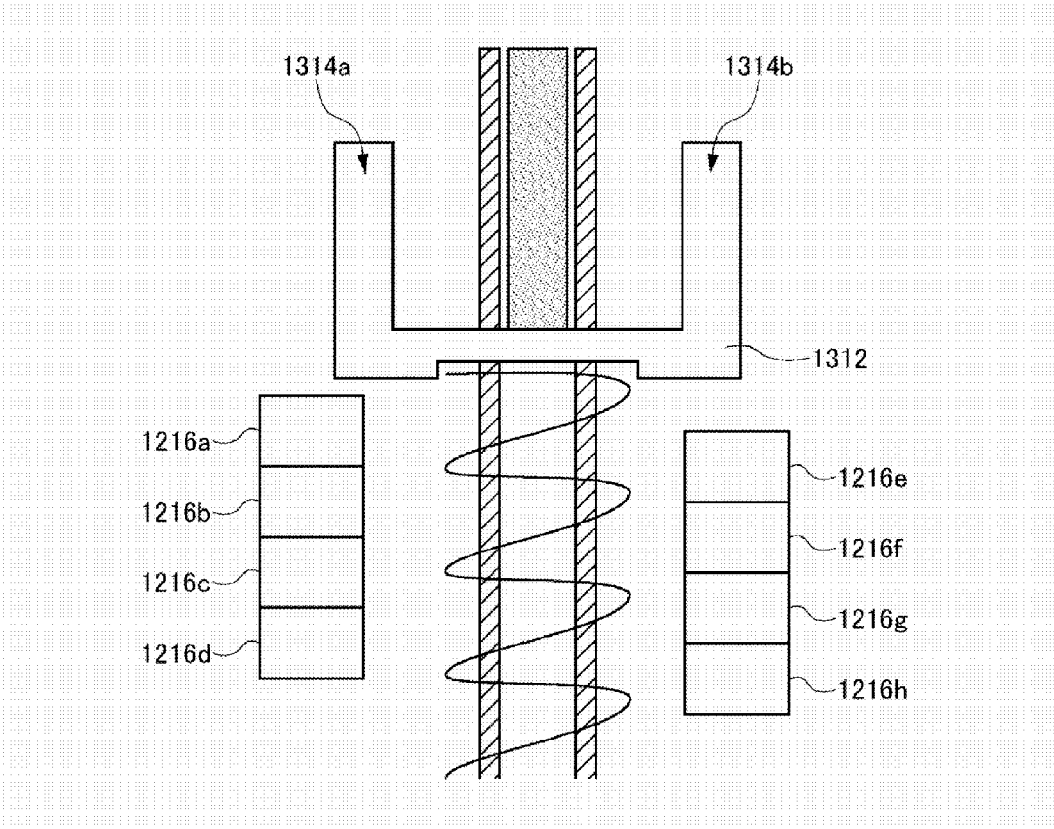
FIG. 22 is a side cross-sectional view of the movable component and depth sensors in the modification.

FIG. 22 is a side cross-sectional view of the movable component 1312 and depth sensors 1216 in the modification. Not only one side but also both sides of the movable component 1216 may have detection portions 1314*a* and 1314*b*. The group of depth sensors 1216*a* to 1216*d* (a first sensor group) and the group of depth sensors 1216*e* to 1216*h* (a second sensor group) are provided for the detection portions 1314*a* and 1314*b*, respectively. The virtual line from the lowest of the detection portion 1314*a* to the lowest of the detection portion 1314*b* is orthogonal to the movable direction of the movable component 1312. The detection portions 1314*a* and 1314*b* are arranged in symmetric position with respect to the axis (z-axis: hereafter it is referred to "movable axis") which is along the movable direction of the movable component 1312.

The depth sensor 1216*a* in the first sensor group, the depth sensor 1216*e* in the second sensor group, the depth sensor 1216*b* in the first sensor group and the like are arranged in this depth order such that a depth sensor in the first sensor group and a depth sensor in the second sensor group is arranged deeper and deeper alternately. With this configuration, eight depth sensors 1216 can identify eight kinds of DC operating voltage. Not to mention, when one DC operating voltage is allocated to the state in which only the check sensor 1318 shows detection, nine kinds of DC operating voltage can be identified. It is not necessary that the detection portions 1314*a* and 1314*b* are both sides of the movable component 1312. The detection portion 1314*a* or 1314*b* maybe part of the movable component 1312, the part is at least positioned outside from the side surface of the hollow portion 1218. It is not necessary that the angle with respect to the movable axis between the detection portions 1314*a* and 1314*b* is 180 degrees. The angle may be arbitrary angle such as 90 or 120 degrees. The first sensor group and the second sensor group may be allocated at corresponding position.

The z-position of the depth sensor 1216*a* in the first sensor group may be same as that of the depth sensor 1216*e* in the second sensor group. The z-position of the depth sensor 1216*b* may be same as that of the depth sensor 1216*f*. The movable component 1312 may be configured such that the bottom of the detection portion 1314*a* is lower (deeper) than that of the detection portion 1314*b*. In this case, when the plug 1100 is being inserted, the depth sensors 1216*a*, 1216*e*, 1216*b*, 1216*f* and the like are detected passing in this order. The depth positions of the depth sensors 1216 can be shifted or the depth positions of the lowest of the detection portions 1314 can be shifted or both of those can be shifted.

Fourth Embodiment

Figure 23:
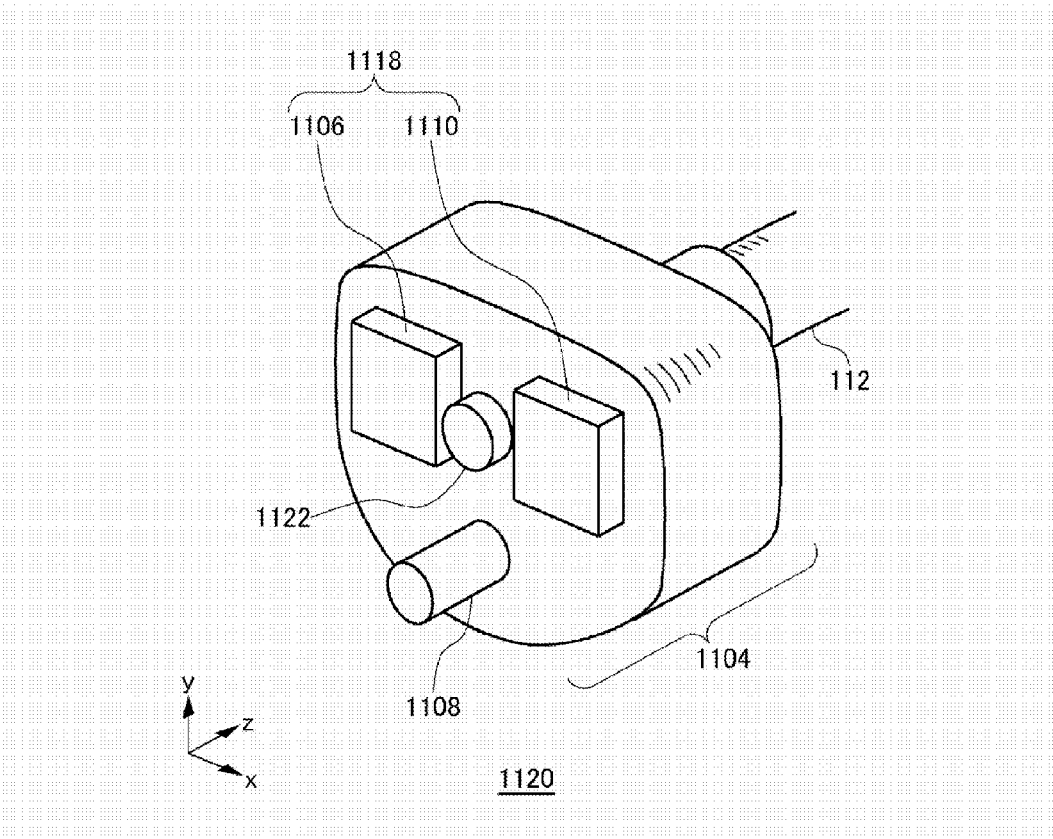
FIG. 23 is a view illustrating the outer appearance of a plug according to the fourth embodiment.

FIG. 23 is a view illustrating the outer appearance of a plug 1120 according to the fourth embodiment. The plug 1120 is connected to the electronic device 400 by the cord 112 extending from the grip unit 1104. The electrode pin 1118 of the plug 1120 is not of a insertion type such as the electrode pin 114 of the second embodiment but of a contact type. A first connection unit 1112 is made of a magnet, which connects the plug 1120 to the plug receiver 200.

Figure 24:
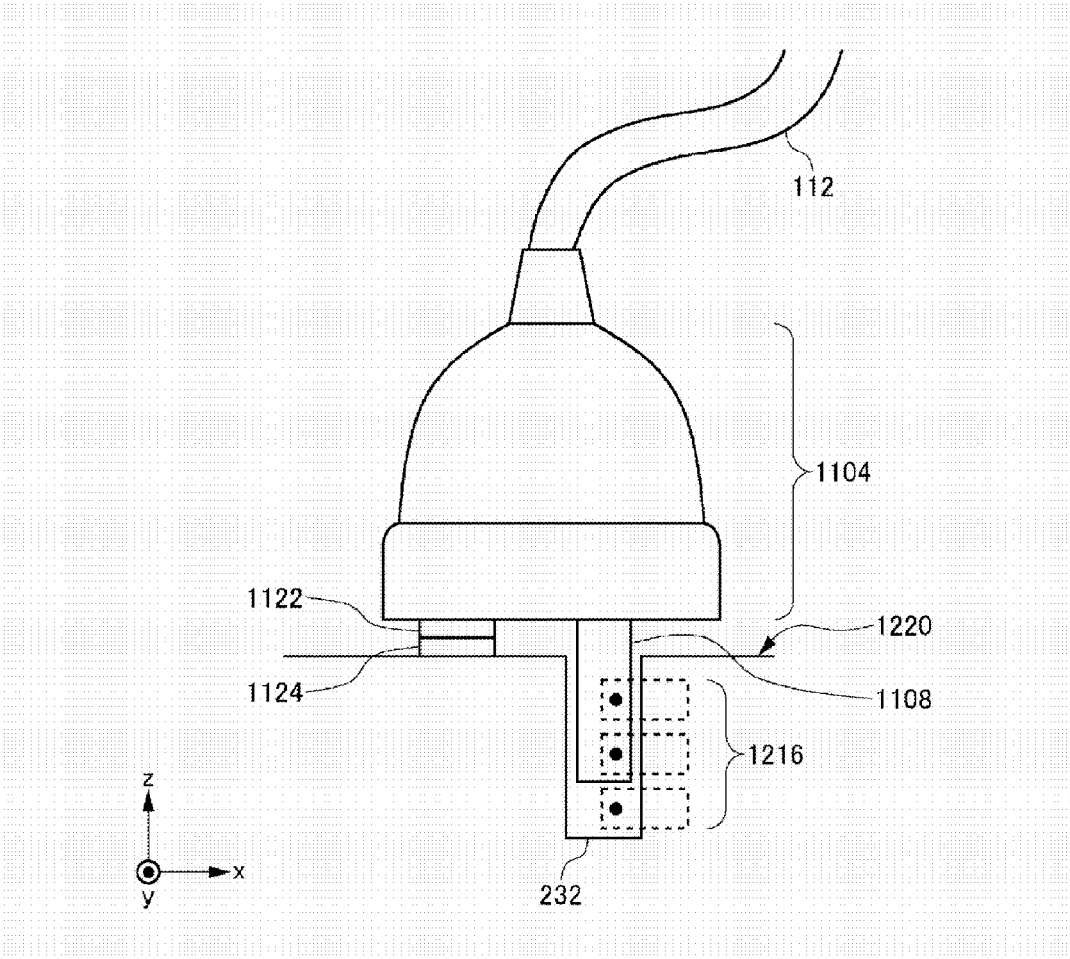
FIG. 24 is a side cross-sectional view illustrating a connection portion between the plug and plug receiver in a state where the plug has been inserted into the plug receiver.

FIG. 24 is a side cross-sectional view illustrating a connection portion between the plug 1120 and plug receiver 1220 in a state where the plug 1120 has been inserted into the plug receiver 1220. When the plug 1120 is connected, the negative terminal 1106 and the positive terminal 1110 contact a negative electrode and a positive electrode (not shown) which are provided on the contact surface of the plug receiver 1220 and receive the DC operating voltage from DC supply. The plug receiver 1220 includes a regulation pin jack 232 for receiving the regulation pin 1108. A plurality of depth sensors 1216 (photoelectric sensors) are arranged along the regulation pin jack 232. The longer the regulation pin 1108 is, the more number of depth sensors 1216 react.

A second connection unit 1124 is further provided on the contact surface of the plug receiver 1220. The second connection unit 1124 is made of a magnet. The first connection unit 1122 and the second connection unit 1124 contact each other and the plug 1120 is fixed to the plug receiver 1220. It is not necessary to make both the first connection unit 1122 and the second connection unit 1124 of a magnet. For example, one of them may be made of other magnetic material, such as iron.

The wiring plug-in connector 300 has been described based on the embodiments. The wiring plug-in connector 300 converts the DC supply voltage into DC operating voltage for supply to the electronic device 400, eliminating the need to perform AC/DC conversion. This reduces a power loss and eliminates the need to use the AC adapter. Further, in the case of the electronic device 400 incorporating the AC adapter, the DC operating voltage passes through the AC adapter without being modified, so that a power loss hardly occurs.

The DC operating voltage is specified by the length of the regulation pin 108, simplifying the configuration of the plug 100 side. Further, the use of the conversion plug 124 or 126 allows the use of the existing AC plug 122. Further, since the regulation pin 108 is exchangeable, the configuration of the plug 100 itself need not be changed depending on the magnitude of the DC operating voltage. The same can be said for the plug 116. Further, the plug 116 has substantially the same outer appearance as an existing plug with earth terminal, increasing compatibility with an existing technique.

In the third embodiment, the depth sensors 1216 and the detection portion 1314 to be detected are arranged outside of the side surface of the hollow portion 1218. The same can be said for the check sensor 1318 and the protrusion 1320. According to the trial manufacture by the inventor, the size of the receiving portion 1210 of the third embodiment is reduced compared with the receiving portion 202 of the first embodiment. Since the check sensor 1318 and the depth sensor 1216 works in close cooperation as described above, the wiring plug-in connector 300 can work safely.

The present invention has been described based on the above embodiments. It should be understood by those skilled in the art that the above embodiments are merely exemplary of the invention, various modifications and changes may be made within the scope of the claims of the present invention, and all such variations may be included within the scope of the claims of the present invention. Thus, the descriptions and drawings in this specification should be considered as not restrictive but illustrative.

Although the electrode pin 114 and regulation pin 108 are provided separately in the present embodiment, they may be realized by one pin. For example, by specifying the DC operating voltage by the length of the negative terminal 106, the negative terminal 106 can function also as the regulation pin 108. As a matter of course, the positive terminal 110 may be made to function as the regulation pin 108 or the DC operating voltage may be specified by the combination of the lengths of the negative and positive terminals 106 and 110.

The regulation pin 108 may be fixed to the plug 116 (or the conversion plug 126). The plug 116 (or the conversion plug 126) which has a regulation pin of different length may be provided. In this case, the plug 116 (or the conversion plug 126) may be changed.

The grip unit 104 may have an adjustment means for adjusting the length of the regulation pin 108. For example, a configuration may be possible in which a dial attached to the grip unit 104 is turned to expose the regulation pin 108 from the inside of the grip unit 104 for adjustment of the length of the regulation pin 108. Such a mechanism for changing the shape of the regulation pin 108 may be provided on the plug 100 side.

In the third embodiment, the positive and negative terminals 1110 and 1106 of the plug 1100 and the positive electrode 1212 or the plug receiver 1200 are of cylinder shape, but these can be configured as metal terminals of plane shape like the second embodiment.

When the voltage identification unit 204 identifies the DC operating voltage, it is not necessary to use both the detection signal from a depth sensor corresponding to an insertion depth A and the detection signal from a depth sensor corresponding to an insertion depth B shallower than the insertion depth A.

The movable component 1312 and/or the detection portion 1314 may not be of plane shape. For example, these can include cylinder-shape portion or prism-shape portion partially. Anyway, these may be at least of a shape which the depth sensors 1216 can detect their passing.

What is claimed is:

1. A plug comprising a plurality of pins to be inserted into a plug receiver for a variable DC voltage supply, wherein the plurality of pins include:

a regulation pin that notifies the variable DC voltage supply of required DC operating voltage; and an electrode pin that receives the specified DC operating voltage from the variable DC voltage supply.

2. The plug according to claim 1, wherein the length of the regulation pin is increased in an insertion depth direction as required DC operating voltage becomes higher.

3. The plug according to claim 1, wherein the regulation pin is detachably configured.

4. The plug according to claim 1, wherein the electrode pin includes a cylindrical first electrode pin and a cylindrical second electrode pin which is concentric to the first electrode pin and has a larger diameter than the first electrode pin, and the regulation pin is provided inside the cylindrical first electrode pin.

5. The plug according to claim 4, wherein the first electrode pin includes a penetration hole into which the regulation pin inserts, the regulation pin includes a flange part which covers the end of the first electrode.

6. The plug according to claim 1, wherein the regulation pin is also used as an earth terminal.

7. A plug comprising a plurality of pins to be inserted into or contacted with a plug receiver for a variable DC voltage supply, wherein the plurality of pins include:

a regulation pin of insertion type that notifies the variable DC voltage supply of required DC operating voltage, by its shape; and an electrode pin of contact type that receives the specified DC operating voltage from the variable DC voltage supply.

8. A plug receiver comprising:

a plurality of jacks for receiving an electrode pin and a regulation pin provided in a plug; and a voltage identification unit that identifies the magnitude of DC operating voltage to be supplied to the electrode pin based on the shape of the regulation pin.

9. The plug receiver according to claim 8, wherein the magnitude of the DC operating voltage identified by the voltage identification unit is increased as the regulation pin is inserted deeper.

10. The plug receiver according to claim 8, further comprising a voltage conversion unit that converts DC voltage supplied from a predetermined DC voltage supply into the identified DC operating voltage.

11. The plug receiver according to claim 10, further comprising a plurality of depth sensors which are arranged in the insertion direction of the plug and detect the insertion depth of the regulation pin, the voltage conversion unit supplies DC operating voltage corresponding to a first insertion depth when a depth sensor corresponding to the first insertion depth detects insertion, under the condition that all of depth sensors corresponding to shallower depth than the first insertion depth detect insertion.

12. The plug receiver according to claim 8, further comprising a detection pin which opposes the regulation pin when the plug is inserted and is movable in the insertion depth direction according to the movement of the regulation pin, the voltage identification unit identifies the magnitude of DC operating voltage by detecting the length of the regulation pin based on the travel distance of the detection pin when the plug is inserted.

13. The plug receiver according to claim 12, further comprising a movable component which moves in the insertion depth direction according to the detection pin; and a plurality of depth sensors which detect a first part of the movable component passing, wherein the first part of the movable component protrudes from the side surface of the region into which the plug is inserted, the plurality of depth sensors are arranged in the passing direction of the first part, the voltage identification unit identifies the travel distance of the detection pin based on the detection signals from the plurality of depth sensors.

14. The plug receiver according to claim 13, wherein the plurality of depth sensors are classified into a first sensor group corresponding to a first part of the movable component and a second sensor group corresponding to a second part of the movable component.

15. The plug receiver according to claim 14, wherein a depth sensor in the first sensor group and a depth sensor in the second sensor group are arranged in deeper and deeper position alternately.

16. The plug receiver according to claim 8, further comprising a check sensor for detecting whether the plug is inserted to a predetermined position.

17. The plug receiver according to claim 9, further comprising:

a plurality of depth sensors which are arranged in the insertion direction of the plug and detect the insertion depth of the regulation pin; and a check sensor for detecting whether the plug is inserted to a predetermined position, wherein the voltage conversion unit supplies first DC operating voltage when only the check sensor reacts, the first DC operating voltage is different from second DC operating voltage when the check sensor and one or more depth sensors react.

18. The plug receiver according to claim 8, further comprising:

a plurality of depth sensors which are arranged in the insertion direction of the plug and detect the insertion depth of the regulation pin;

a check sensor for detecting whether the plug is inserted to a predetermined position; and a voltage conversion unit that converts DC voltage supplied from a predetermined DC voltage supply into the identified DC operating voltage, wherein the magnitude of the DC operating voltage identified by the voltage identification unit is increased as the regulation pin is inserted deeper, the voltage conversion unit supplies the DC operating voltage to the electrode pin under the condition that the check sensor reacts.

19. The plug receiver according to claim 10, further comprising:

a voltage display unit that displays the magnitude of the identified DC operating voltage; and a determination input unit that receives a determination input for determining the identified DC operating voltage from a user, wherein the voltage conversion unit supplies the identified DC operating voltage to the electrode pin under the condition that the determination input has been received.

20. A wiring plug-in connector comprising a plug and a plug receiver receiving a plurality of pins provided in the plug, wherein the plug includes:

a regulation pin that specifies required DC operating voltage by the shape thereof; and an electrode pin that receives the specified DC operating voltage from the plug receiver, and the plug receiver includes:

a plurality of jacks for receiving the electrode pin and regulation pin; and a voltage identification unit that identifies the magnitude of DC operating voltage to be supplied to the electrode pin based on the shape of the regulation pin.

* * * * *